US011028469B2

(12) United States Patent
Sakakibara et al.

(10) Patent No.: US 11,028,469 B2
(45) Date of Patent: Jun. 8, 2021

(54) HOT PRESS-FORMED PART

(71) Applicant: NIPPON STEEL & SUMITOMO METAL CORPORATION, Tokyo (JP)

(72) Inventors: Mutsumi Sakakibara, Tokyo (JP); Natsuko Sugiura, Tokyo (JP); Kunio Hayashi, Tokyo (JP); Kaoru Kawasaki, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 197 days.

(21) Appl. No.: 16/323,307

(22) PCT Filed: Aug. 16, 2016

(86) PCT No.: PCT/JP2016/073896
§ 371 (c)(1),
(2) Date: Feb. 5, 2019

(87) PCT Pub. No.: WO2018/033960
PCT Pub. Date: Feb. 22, 2018

(65) Prior Publication Data

US 2020/0157666 A1 May 21, 2020

(51) Int. Cl.
*C22C 38/58* (2006.01)
*B21D 22/02* (2006.01)
(Continued)

(52) U.S. Cl.
CPC ..... *C22C 38/58* (2013.01); *B21D 22/022* (2013.01); *C21D 1/673* (2013.01); *C21D 6/002* (2013.01);
(Continued)

(58) Field of Classification Search
CPC ..... C22C 38/58; B21D 22/022; C21D 1/673; C21D 6/002; C21D 8/0247
See application file for complete search history.

(56) References Cited

U.S. PATENT DOCUMENTS

2007/0089814 A1 4/2007 Sugiura et al.
2008/0008901 A1 1/2008 Sugiura et al.
(Continued)

FOREIGN PATENT DOCUMENTS

CN 103547694 A 1/2014
CN 105849294 A 8/2016
(Continued)

OTHER PUBLICATIONS

Russian Office Action for counterpart Russian Application No. 2019105060, dated Sep. 27, 2019, with English translation.
(Continued)

*Primary Examiner* — Nicholas A Wang
*Assistant Examiner* — Jiangtian Xu
(74) *Attorney, Agent, or Firm* — Birch, Stewart, Kolasch & Birch, LLP

(57) ABSTRACT

A hot press-formed part according to an aspect of the present invention contains a predetermined chemical composition; in which a microstructure in a thickness ¼ portion includes, by unit vol %, tempered martensite: 20% to 90%, bainite: 5% to 75%, and residual austenite: 5% to 25%, and ferrite is limited to 10% or less; and a pole density of an orientation {211}<011> in the thickness ¼ portion is 3.0 or higher.

16 Claims, 1 Drawing Sheet

(51) Int. Cl.

| | |
|---|---|
| ***C21D 1/673*** | (2006.01) |
| ***C21D 6/00*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/08*** | (2006.01) |
| ***C22C 38/12*** | (2006.01) |
| ***C22C 38/14*** | (2006.01) |
| ***C22C 38/16*** | (2006.01) |
| ***C22C 38/44*** | (2006.01) |

(52) U.S. Cl.

CPC ..... *C21D 6/005* (2013.01); *C21D 6/008* (2013.01); *C22C 38/001* (2013.01); *C22C 38/002* (2013.01); *C22C 38/005* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/16* (2013.01); *C22C 38/44* (2013.01); *C21D 2211/001* (2013.01); *C21D 2211/002* (2013.01); *C21D 2211/005* (2013.01); *C21D 2211/008* (2013.01)

(56) References Cited

U.S. PATENT DOCUMENTS

| | | | |
|---|---|---|---|
| 2014/0000765 | A1 | 1/2014 | Nozaki et al. |
| 2014/0096876 | A1* | 4/2014 | Matsuda ..... C22C 38/04 148/653 |
| 2014/0242415 | A1 | 8/2014 | Azuma et al. |
| 2015/0027593 | A1 | 1/2015 | Hata et al. |
| 2015/0203949 | A1 | 7/2015 | Yokoi et al. |
| 2016/0312331 | A1 | 10/2016 | Cho et al. |
| 2017/0029914 | A1 | 2/2017 | Hayashi |

FOREIGN PATENT DOCUMENTS

| | | | |
|---|---|---|---|
| EP | 2660345 | A2 | 11/2013 |
| JP | 1-230715 | A | 9/1989 |
| JP | 2-217425 | A | 8/1990 |
| JP | 2002-18531 | A | 1/2002 |
| JP | 2005-256020 | A | 9/2005 |
| JP | 2007-46146 | A | 2/2007 |
| JP | 2011-184758 | A | 9/2011 |
| JP | 2011-214070 | A | 10/2011 |
| JP | 2011-214072 | A | 10/2011 |
| JP | 2011-214081 | A | 10/2011 |
| JP | 2012-233229 | A | 11/2012 |
| JP | 2013-14825 | A | 1/2013 |
| JP | 2013-14842 | A | 1/2013 |
| JP | 2013-174004 | A | 9/2013 |
| JP | 2014-37595 | A | 2/2014 |
| JP | 2015-151600 | A | 8/2015 |
| JP | 2016-8310 | A | 1/2016 |
| JP | 2016-28172 | A | 2/2016 |
| KR | 10-2012-0073407 | A | 7/2012 |
| KR | 10-2016-0090865 | A | 8/2016 |
| RU | 2431694 | C2 | 10/2011 |
| RU | 2484174 | C1 | 6/2013 |
| RU | 2581330 | C2 | 4/2016 |
| RU | 2587106 | C2 | 6/2016 |
| TW | 201319266 | A1 | 5/2013 |
| TW | 201425599 | A | 7/2014 |
| WO | WO 2012/133540 | A1 | 10/2012 |
| WO | WO 2013/125399 | A1 | 8/2013 |
| WO | WO 2015/099382 | A1 | 7/2015 |
| WO | WO 2016/001704 | A1 | 1/2016 |
| WO | WO 2016/063467 | A1 | 4/2016 |

OTHER PUBLICATIONS

Korean Office Action, dated May 19, 2020, for counterpart Korean Application No. 10-2019-7005063, along with an Machine translation.

Chinese Office Action and Search Report for counterpart Chinese Application No. 201680088418.X, dated Apr. 27, 2020, with English translation of the Search Report.

"Metallic materials—Bend test", JIS Z 2248, 2006, total 18 pages.

"Metallic materials—Sheet and strip-Determination of plastic strain ratio", JIS Z 2254, 2008, total 19 pages.

"Test pieces for tensile test for metallic materials", JIS Z 2201, 1998, total 6 pages.

International Search Report for PCT/JP2016/073896 dated Nov. 1, 2016.

Kawata et al., "Effect of Martensite in Initial Structure on Bainite Transformation", Materials Science Forum, 2010, vols. 638-642, pp. 3307-3312.

Office Action for TW 105126067 dated Mar. 28, 2017.

Written Opinion of the International Searching Authority for PCT/JP2016/073896 (PCT/ISA/237) dated Nov. 1, 2016.

Extended European Search Report dated Dec. 20, 2019 for corresponding Application No. 16913489.7.

* cited by examiner

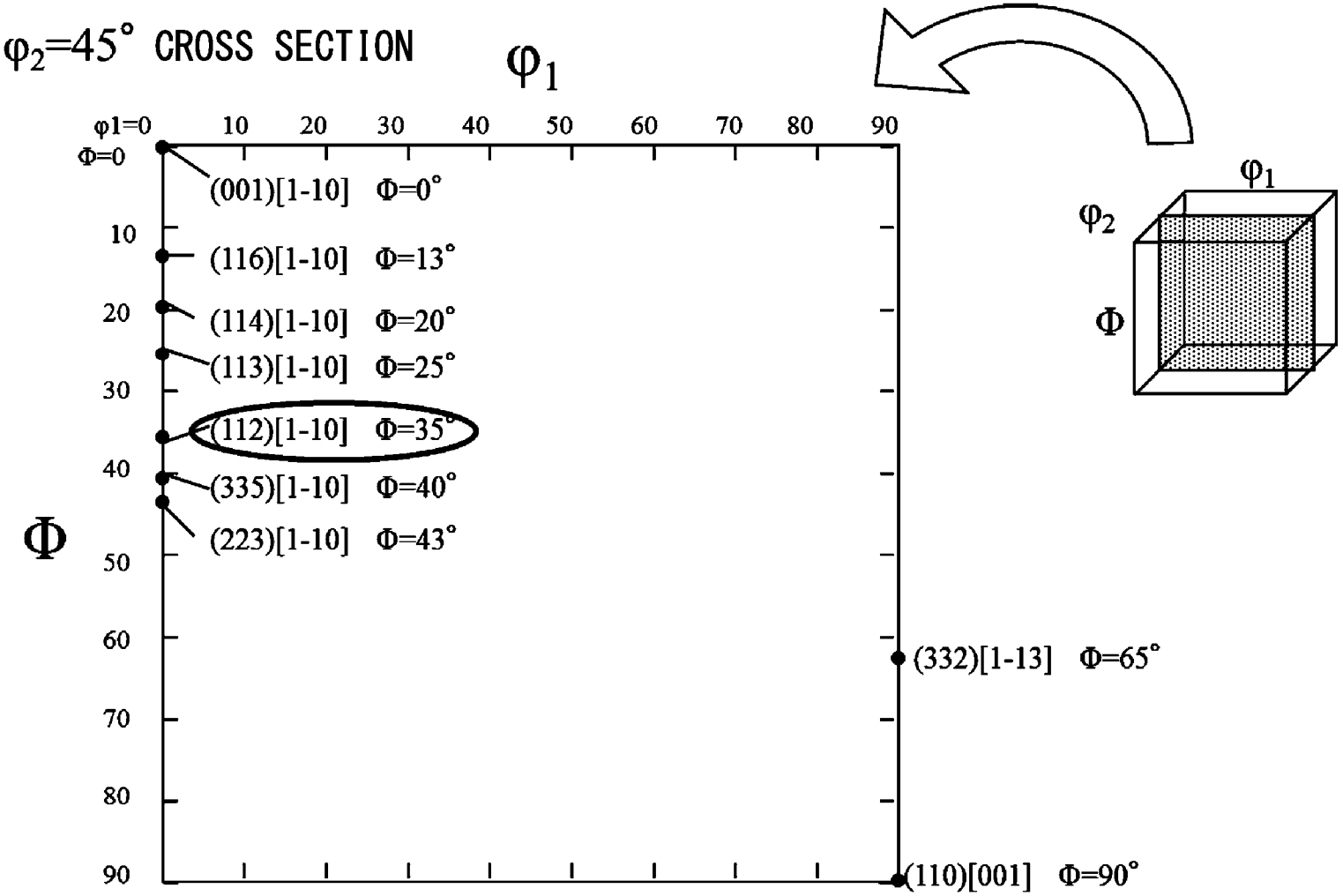
φ2=45° CROSS SECTION
φ1
φ1=0
Φ=0
10
20
30
40
50
60
70
80
90
Φ
(001)[1-10] Φ=0°
(116)[1-10] Φ=13°
(114)[1-10] Φ=20°
(113)[1-10] Φ=25°
(112)[1-10] Φ=35°
(335)[1-10] Φ=40°
(223)[1-10] Φ=43°
(332)[1-13] Φ=65°
(110)[001] Φ=90°
φ1
φ2
Φ

HOT PRESS-FORMED PART

TECHNICAL FIELD OF THE INVENTION

The present invention relates to a hot press-formed part.

RELATED ART

In parts for automobiles, such as door guards, front-side parts, cross parts, and side parts, weight reduction is required for improvement of fuel efficiency. As a way of reducing the weight, thinning of a material can be conceived. However, the parts for automobiles described above also demand high strength. Therefore, high-strengthening of steel sheets, which become materials of the parts, is proceeding such that collision safety and the like are sufficiently ensured even after being thinned. Specifically, there has been an attempt to improve a tensile product which is the product of ductility and tensile strength, a Lankford value, and limitation of bending.

The parts for automobiles described above as examples are often manufactured through hot pressing. A hot pressing technology is a technology, in which a steel sheet is press-formed after being heated to a high temperature of an austenite zone and which requires an extremely small forming load compared to ordinary press working performed at room temperature. Moreover, in the hot pressing technology, since hardening treatment is performed inside a die at the same time as the press forming is performed, a steel sheet can have high strength. Therefore, the hot pressing technology is attracting attention as a technology which can realize both shape fixability and ensuring the strength (for example, refer to Patent Document 1).

However, although a part obtained by processing a steel sheet using a hot pressing technology (which will hereinafter be sometimes simply referred to as a "hot press-formed part") has excellent strength, there are cases where ductility cannot be sufficiently achieved. At the time of collision of an automobile, sometimes a surface layer area of a hot press-formed part intensely receives bending deformation due to extreme plastic deformation occurred in parts for automobiles. In a case where the hot press-formed part has insufficient ductility, there is concern that cracking will be caused in the hot press-formed part due to the intense bending deformation. That is, there is concern that an ordinary hot press-formed part will not be able to exhibit excellent collision characteristics.

On the other hand, a transformed induced plasticity (TRIP) steel utilizing martensitic transformation of residual austenite to have excellent ductility is also known (refer to Patent Documents 2 and 3).

Generally, a TRIP steel can include stable residual austenite in its structure even at room temperature by performing bainitic transformation through heat treatment. However, if high-strengthening is promoted, bainitic transformation is delayed. Therefore, a long period of time is required to generate residual austenite. In this case, productivity is significantly impaired. In addition, in a case where a retention time at the time of generating bainite is insufficient, unstable austenite, which has not been transformed, becomes full hard martensite at room temperature. Consequently, there is concern that ductility and bendability of a part will deteriorate and sufficient collision characteristics will not be able to be achieved.

As a technology of promoting bainitic transformation, a technology, in which a steel is annealed in an austenite single phase range, is subsequently cooled to a temperature within a range of an Ms point to an Mf point, is reheated to a temperature of 350° C. or higher and 400° C. or lower, and is then retained, is known (for example, refer to Non-Patent Document 1). According to this technology, stable residual austenite can be obtained in a shorter period of time.

In the related art, TRIP steels have been adopted as steel sheets for cold forming due to their excellent ductility. However, in a case where a part is manufactured through cold forming, residual ductility of the formed part affects collision characteristics of the part. The residual ductility decreases in a region subjected to high working at the time of cold forming. Thus, there is concern that cracking will be caused at the time of collision. Therefore, recently, in a hot press forming method as well, a method, in which the ductility of a part is ensured by providing residual austenite in a steel sheet, has been proposed (for example, refer to Patent Documents 4 to 6).

Patent Document 4 discloses a technology in which residual austenite is contained in a part by causing an average cooling rate of a steel within a range of (Ms point-150°) C. to 40° C. to be 5° C./sec or slower in the hot press forming method. However, it has been confirmed that it is difficult to ensure the amount of residual austenite which can significantly improve the ductility, by only controlling the cooling rate.

Patent Document 5 discloses a technology in which after a steel is cooled to a temperature range of (bainitic transformation start temperature Bs−100° C.) or higher and the Ms point or lower, the steel stays at this temperature 10 seconds or longer in the hot press forming method. However, in this technology, a bainitic transformation rate is slow, and there is high possibility that residual austenite will become full hard martensite after being cooled. If full hard martensite is generated, the hardness difference between structures increases. Thus, there is concern that excellent bendability will not be able to be exhibited.

Patent Document 6 discloses a technology of obtaining stable residual austenite in the hot press forming method, in which after a steel is retained at a temperature of 750° C. or higher and 1,000° C. or lower, the steel is cooled to a first temperature of 50° C. or higher and 350° C. or lower to be partially subjected to martensitic transformation, and then the steel is subjected to bainitic transformation by being reheated to a second temperature range of 350° C. or higher and 490° C. or lower. However, in this technology as well, there is concern that excellent bendability will not be able to be exhibited. The reason is that textures of a steel sheet before hot pressing are not defined in any way.

PRIOR ART DOCUMENT

Patent Document

[Patent Document 1] Japanese Unexamined Patent Application, First Publication No. 2002-18531

[Patent Document 2] Japanese Unexamined Patent Application, First Publication No. H1-230715

[Patent Document 3] Japanese Unexamined Patent Application, First Publication No. H2-217425

[Patent Document 4] Japanese Unexamined Patent Application, First Publication No. 2013-174004

[Patent Document 5] Japanese Unexamined Patent Application, First Publication No. 2013-14842

[Patent Document 6] Japanese Unexamined Patent Application, First Publication No. 2011-184758

Non-Patent Document

[Non-Patent Document 1] H. Kawata, K. Hayashi, N. Sugiura, N. Yoshinaga, and M. Takahashi: Materials Science Forum, 638-642 (2010), p 3307

DISCLOSURE OF THE INVENTION

Problems to be Solved by the Invention

The present invention has been made in consideration of the foregoing circumstances, and an object thereof is to provide a high strength hot press-formed part having excellent ductility and bendability. Specifically, an object of the present invention is to provide a high strength hot press-formed part in which a tensile product is 26,000 (MPa·%) or greater, both a Lankford value for a rolling direction and a Lankford value for a direction perpendicular to the rolling direction (which will hereinafter be sometimes simply referred to as an "transvers direction") are 0.80 or smaller, and both limitation of bending in the rolling direction and limitation of bending in the transvers direction are 2.0 or smaller. Hereinafter, the Lankford value will be sometimes simply referred to as an "r value".

Means for Solving the Problem

The gist of the present invention is as follows.

(1) According to an aspect of the present invention, a hot press-formed part contains, by unit mass %, C: 0.100% to 0.600%, Si: 1.00% to 3.00%, Mn: 1.00% to 5.00%, P: 0.040% or less, S: 0.0500% or less, Al: 0.001% to 2.000%, N: 0.0100% or less, O: 0.0100% or less, Mo: 0% to 1.00%, Cr: 0% to 2.00%, Ni: 0% to 2.00%, Cu: 0% to 2.00%, Nb: 0% to 0.300%, Ti: 0% to 0.300%, V: 0% to 0.300%, B: 0% to 0.1000%, Ca: 0% to 0.0100%, Mg: 0% to 0.0100%, REM: 0% to 0.0100%, and a remainder including Fe and impurities; in which, a microstructure in a thickness ¼ portion includes, by unit vol %, tempered martensite: 20% to 90%, bainite: 5% to 75%, and residual austenite: 5% to 25%, and ferrite is limited to 10% or less, and a pole density of an orientation {211}<011> in the thickness ¼ portion is 3.0 or higher.

(2) The hot press-formed part according to (1) may contain, by unit mass %, at least one selected from the group consisting of Mo: 0.01% to 1.00%, Cr: 0.05% to 2.00%, Ni: 0.05% to 2.00%, and Cu: 0.05% to 2.00%.

(3) The hot press-formed part according to (1) or (2) may contain, by unit mass %, at least one selected from the group consisting of Nb: 0.005% to 0.300%, Ti: 0.005% to 0.300%, and V: 0.005% to 0.300%.

(4) The hot press-formed part according to any one of (1) to (3) may contain, by unit mass %, B: 0.0001% to 0.1000%.

(5) The hot press-formed part according to any one of (1) to (4) may contain, by unit mass %, at least one selected from the group consisting of Ca: 0.0005% to 0.0100%, Mg: 0.0005% to 0.0100%, and REM: 0.0005% to 0.0100%.

Effects of the Invention

In the high strength hot press-formed part according to the aspect of the present invention, when adjusting the composition and the structure of a steel, particularly the structure of the steel is caused to be a composite structure, and the proportion of each of the structures constituting the composite structure is ameliorated. Moreover, in the high strength hot press-formed part according to the aspect of the present invention, the pole density of a steel is preferably controlled as well. Consequently, in the high strength hot press-formed part according to the aspect of the present invention, not only excellent strength can be achieved due to martensite in the composite structure but also excellent ductility due to austenite and excellent bendability due to bainite can be ensured as well. As a result, in the high strength hot press-formed part according to the aspect of the present invention, both an r value for a rolling direction and the r value for a transvers direction can be 0.80 or smaller, and both limitation of bending in the rolling direction and limitation of bending in the transvers direction can be 2.0 or smaller.

BRIEF DESCRIPTION OF THE DRAWING

FIG. 1 is a view illustrating a position of a main crystal orientation on an ODF ($\phi 2=45°$ cross section).

EMBODIMENT OF THE INVENTION

Hereinafter, an embodiment of a high strength hot press-formed part according to the present invention will be described in detail. The embodiment described below does not limit the present invention. In addition, constituent elements of the embodiment include elements which can be easily replaced by those skilled in the art or substantially the same elements. Moreover, various forms included in the following embodiment can be combined in any desired manner within a range obvious to those skilled in the art.

In the part according to the present embodiment, a "thickness ¼ portion of a part" denotes a region between an approximately ⅛ depth plane and an approximately ⅜ depth plane in a sheet thickness of the part from a rolled surface of the part. The rolled surface of the part is a rolled surface of a hot pressing element sheet (a cold-rolled steel sheet or an annealed steel sheet) which is a material of the part. A "thickness ¼ portion of a hot pressing element sheet" denotes a region between an approximately ⅛ depth plane and an approximately ⅜ depth plane in the sheet thickness of the hot pressing element sheet from the rolled surface of the hot pressing element sheet. The thickness of the part according to the present embodiment is not uniform, and the sheet thickness increases and decreases in a region subjected to working. A thickness ¼ portion of a part in a region subjected to working is a region corresponding to the thickness ¼ portion of a hot pressing element sheet before being subjected to working and can be specified based on the shape of a cross section.

The inventors have intensively repeated investigations to achieve the object described above and have consequently ascertained that, in order to improve ductility and bendability of a hot press-formed part, it is important to cause the structure of a steel having a predetermined composition to be a composite structure including tempered martensite, residual austenite, and bainite and to suitably set the proportion of each of these structures. More specifically, the inventors have ascertained that not only excellent strength can be achieved due to martensite in the composite structure but also excellent ductility due to austenite and excellent bendability due to bainite can be ensured as well in hot press forming through a process in which a steel sheet having a predetermined composition is formed at a high temperature, and after being temporarily cooled, the steel sheet is reheated and retained, so that both a Lankford value (r value) for a rolling direction and the r value for a transvers direction can be 0.80 or smaller and both limitation of bending in the rolling direction and limitation of bending in the transvers direction can be 2.0 or smaller, as a result.

The Lankford value (r value) is a ratio $\varepsilon_b/\varepsilon_a$ between true strain $\varepsilon_b$ of a plate-shaped tension test piece, which is defined in JIS Z 2254, in a width direction and true strain Ea thereof in a thickness direction which are caused when uniaxial tensile stress is applied to the test piece. The r value for the rolling direction is an r value obtained by applying uniaxial tensile stress in a direction parallel to the rolling direction, and the r value for the transvers direction is an r value obtained by applying uniaxial tensile stress in a direction perpendicular to the rolling direction.

<High Strength Hot Press-Formed Part>

Hereinafter, the embodiment of the high strength hot press-formed part according to the present embodiment will be described in detail.

[Composition]

First, the reasons for limiting the compositions of the high strength hot press-formed part according to the present embodiment (which will hereinafter be sometimes referred to as the part) will be described. In this specification, the unit "%" in a chemical composition denotes "mass %".

(C: 0.100% to 0.600%)

Carbon (C) is an essential element so as to increase strength of a part and to ensure the residual austenite of a predetermined amount or more. If the C content is less than 0.100%, it is difficult to ensure the tensile strength and the ductility of a part. On the other hand, if the C content exceeds 0.600%, it is difficult to ensure the spot weldability of a part, and there is concern that ductility of a part will be deteriorated. Due to the above reasons, the C content is set to a range of 0.100% to 0.600%. The lower limit value for the C content is preferably 0.150%, 0.180%, or 0.200%. The upper limit value for the C content is preferably 0.500%, 0.480%, or 0.450%.

(Si: 1.00% to 3.00%)

Silicon (Si) is a strengthening element, which is effective in increasing strength of a part. In addition, Si minimizes precipitation and coarsening of cementite in martensite, thereby contributing to improvement of high-strengthening and bendability of a part. Moreover, Si is an element which contributes to ensuring the residual austenite of a predetermined amount or more by increasing the C concentration in austenite and contributes to minimizing precipitation of cementite during reheating and holding after the part is temporarily cooled.

If the Si content is less than 1.00%, the above effects (high-strengthening of a steel, minimizing precipitation of cementite, and the like) cannot be sufficiently achieved. On the other hand, if the Si content exceeds 3.00%, formability of a part is deteriorated. Due to the above reasons, the Si content is set to a range of 1.00% to 3.00%. The lower limit value for the Si content is preferably 1.10%, 1.20%, or 1.30%. The upper limit value for the Si content is preferably 2.50%, 2.40%, or 2.30%.

(Mn: 1.00% to 5.00%)

Manganese (Mn) is a strengthening element, which is effective in increasing strength of a part. If the Mn content is less than 1.00%, ferrite, pearlite, and cementite are generated while a part is cooled, so that it is difficult to enhance strength of a part. On the other hand, if the Mn content exceeds 5.00%, co-segregation of Mn with P and S is likely to occur, so that formability of a part significantly is deteriorated. Due to the above reasons, the Mn content is set to a range of 1.00% to 5.00%. The lower limit value for the Mn content is preferably 1.80%, 2.00%, or 2.20%. The upper limit value for the Mn content is preferably 4.50%, 4.00%, or 3.50%.

(P: 0.040% or Less)

Phosphorus (P) is an element which tends to segregate to a thickness central portion of a steel sheet constituting a part (a region between an approximately ⅜ depth plane and an approximately ⅝ depth plane in the sheet thickness of a part from a rolled surface) and embrittles a weld portion formed when the part is welded. If the P content exceeds 0.040%, a weld portion significantly embrittles. Therefore, the P content is set to 0.040% or less. A preferable upper limit value for the P content is 0.010%, 0.009%, or 0.008%. In addition, since it is not particularly necessary to set the lower limit value for the P content, the lower limit value for the P content may be set to 0%. However, since it is economically disadvantageous to set the P content to be less than 0.0001%, the lower limit value for the P content may be set to 0.0001%.

(S: 0.0500% or Less)

Sulfur (S) is an element which adversely affects weldability of a part and manufacturability at the time of casting and at the time of hot rolling of a steel sheet constituting a part. In addition, S is an element which forms coarse MnS and hinders bendability, hole expansion ratio, and the like of a part. If the S content exceeds 0.0500%, since the adverse effect and the hindrance described above become significant, the S content is set to 0.0500% or less. A preferable upper limit value for the S content is 0.0100%, 0.0080%, or 0.0050%. In addition, since it is not particularly necessary to set the lower limit value for S, the lower limit value for the S content may be set to 0%. However, since it is economically disadvantageous to set the S content to be less than 0.0001%, the lower limit value for the S content may be set to 0.0001%.

(Al: 0.001% to 2.000%)

Similar to Si, aluminum (Al) is an element which is effective in minimizing precipitation and coarsening of cementite, and the like. In addition, Al is an element which can also be utilized as a deoxidizing agent. If the Al content is less than 0.001%, the above effects are not manifested. On the other hand, if the Al content exceeds 2.000%, the number of Al-based coarse inclusions increases, thereby causing deterioration of bendability of a steel sheet and causing occurrence of scratches on a surface of a steel sheet. Due to the above reasons, the Al content is set to a range of 0.001% to 2.000%. The lower limit value for the Al content is preferably, 0.010%, 0.020%, or 0.030%. The upper limit value for the Al content is preferably 1.500%, 1.200%, 1.000%, 0.250%, or 0.050%.

(N: 0.0100% or Less)

Nitrogen (N) is an element which forms coarse nitride and causes deterioration of bendability and hole expansion ratio of a part. Moreover, N is an element causing generation of blowholes at the time of welding a part. If the N content exceeds 0.0100%, since not only deterioration of bendability and hole expansion ratio of a part becomes significant but also many blowholes are generated at the time of welding a part, the N content is set to 0.0100% or less. A preferable upper limit value for the N content is 0.0070%, 0.0050%, or 0.0030%. In addition, since it is not particularly necessary to set the lower limit value for the N content, it may be set to 0%. However, since setting the N content to be less than 0.0005% may lead to a drastic increase in the manufacturing cost, the lower limit value for the N content may be set to 0.0005%.

(O: 0.0100% or Less)

Oxygen (O) is an element which forms oxide and causes deterioration of fracture elongation, bendability, hole expansion ratio, and the like of a part. Particularly, if oxide is present as inclusions on a punctured end surface or a cut surface of a part, the oxide forms notch-shaped scratches, coarse dimples, or the like and leads to stress concentration at the time of hole expanding, at the time of high working, or the like, thereby causing cracks and causing drastic deterioration of hole expansion ratio and/or bendability.

If the O content exceeds 0.0100%, deterioration of fracture elongation, bendability, hole expansion ratio, and the like becomes significant. Therefore, the O content is set to 0.0100% or less. A preferable upper limit value for the O content is 0.0050%, 0.0040%, or 0.0030%. In addition, since it is not particularly necessary to set the lower limit value for the O content, it may be set to 0%. However, since setting the O content to be less than 0.0001% may lead to an excessive cost rise and is not economically preferable, the lower limit value for the O content may be set to 0.0001%.

In addition, in addition to the above elements, the high strength hot press-formed part according to the present embodiment may contain at least one selected from the group consisting of Mo: 0.01% to 1.00%, Cr: 0.05% to 2.00%, Ni: 0.05% to 2.00%, and Cu: 0.05% to 2.00%. However, these elements are not essential elements. Even in a case where these elements are not contained, the part according to the present embodiment can solve the problem. Therefore, the lower limit value for the amounts of these elements is 0%.

(Mo: 0% to 1.00%)

Molybdenum (Mo) is a strengthening element and is an element which contributes to improvement of hardenability of a steel sheet constituting a part. In order to achieve these effects, the lower limit value for the Mo content may be set to 0.01%. On the other hand, if the Mo content exceeds 1.00%, there are cases where manufacturability at the time of manufacturing and at the time of hot rolling of a steel sheet is hindered. Due to the above reasons, the Mo content is preferably set to 0.01% or more and 1.00% or less. A more preferable lower limit value for the Mo content is 0.05%, 0.10%, or 0.15%. A more preferable upper limit value for the Mo content is 0.60%, 0.50%, or 0.40%.

(Cr: 0% to 2.00%)

Chromium (Cr) is a strengthening element and is an element which contributes to improvement of hardenability of a steel sheet constituting a part. In order to achieve these effects, the lower limit value for the Cr content may be set to 0.05%. On the other hand, if the Cr content exceeds 2.00%, there are cases where manufacturability at the time of manufacturing and at the time of hot rolling of a steel sheet is hindered. Due to the above reasons, the Cr content is preferably set to 0.05% or more and 2.00% or less. A more preferable lower limit value for the Cr content is 0.10%, 0.15%, or 0.20%. A more preferable upper limit value for the Cr content is 1.80%, 1.60%, or 1.40%.

(Ni: 0% to 2.00%)

Nickel (Ni) is a strengthening element and is an element which contributes to improvement of hardenability of a steel sheet constituting a part. In addition, Ni is an element which contributes to improvement of wettability of a steel sheet and promotion of alloying reaction. In order to achieve these effects, the lower limit value for the Ni content may be set to 0.05%. On the other hand, if the Ni content exceeds 2.00%, there are cases where manufacturability at the time of manufacturing and at the time of hot rolling of a steel sheet is hindered. Due to the above reasons, the Ni content is preferably set to 0.05% or more and 2.00% or less. A more preferable lower limit value for the Ni content is 0.10%, 0.15%, or 0.20%. A more preferable upper limit value for the Ni content is 1.80%, 1.60%, or 1.40%.

(Cu: 0% to 2.00%)

Copper (Cu) is a strengthening element and is an element which contributes to improvement of hardenability of a steel sheet constituting a part. In addition, Cu is an element which contributes to improvement of wettability of a steel sheet and promotion of alloying reaction. In order to achieve these effects, the lower limit value for the Cu content may be set to 0.05%. On the other hand, if the Cu content exceeds 2.00%, there are cases where manufacturability at the time of manufacturing and at the time of hot rolling of a steel sheet is hindered. Due to the above reasons, the Cu content is preferably set to 0.05% or more and 2.00% or less. A more preferable lower limit value for the Cu content is 0.10%, 0.15%, or 0.20%. A more preferable upper limit value for the Cu content is 1.80%, 1.60%, or 1.40%.

Moreover, in addition to the above elements, the high strength hot press-formed part according to the present embodiment may contain at least one of Nb: 0.005% to 0.300%, Ti: 0.005% to 0.300%, and V: 0.005% to 0.300%. However, these elements are not essential elements. Even in a case where these elements are not contained, the part according to the present embodiment can solve the problem. Therefore, the lower limit value for the amounts of these elements is 0%.

(Nb: 0% to 0.300%)

Niobium (Nb) is a strengthening element and is an element which contributes to increasing strength of a part due to strengthening of precipitates, strengthening of grain refinement realized by minimizing growth of ferrite grains, and strengthening of dislocation realized by minimizing recrystallization. In order to achieve these effects, the lower limit value for the Nb content may be set to 0.005%. On the other hand, if the Nb content exceeds 0.300%, there are cases where carbonitride is excessively precipitated such that formability of a part is deteriorated. Due to the above reasons, the Nb content is preferably set to 0.005% or more and 0.300% or less. A more preferable lower limit value for the Nb content is 0.008%, 0.010%, or 0.012%. A more preferable upper limit value for the Nb content is 0.100%, 0.080%, or 0.060%.

(Ti: 0% to 0.300%)

Titanium (Ti) is a strengthening element and is an element which contributes to increasing strength of a part due to strengthening of precipitates, strengthening of grain refinement realized by minimizing growth of ferrite grains, and strengthening of dislocation realized by minimizing recrystallization. In order to achieve these effects, the lower limit value for the Ti content may be set to 0.005%. On the other hand, if the Ti content exceeds 0.300%, there are cases where carbonitride is excessively precipitated such that formability of a part is deteriorated. Due to the above reasons, the Ti content is preferably set to 0.005% or more and 0.300% or less. A more preferable lower limit value for the Ti content is 0.010%, 0.015%, or 0.020%. A more preferable upper limit value for the Ti content is 0.200%, 0.150%, or 0.100%.

(V: 0% to 0.300%)

Vanadium (V) is a strengthening element and is an element which contributes to increasing strength of a part due to strengthening of precipitates, strengthening of grain refinement realized by minimizing growth of ferrite grains, and strengthening of dislocation realized by minimizing recrystallization. In order to achieve these effects, the lower limit value for the V content may be set to 0.005%. On the other hand, if the V content exceeds 0.300%, there are cases where carbonitride is excessively precipitated such that formability of a part is deteriorated. Due to the above reasons, the V content is preferably set to 0.005% or more and 0.300% or less. A more preferable lower limit value for the V content is 0.010%, 0.015%, or 0.020%. A more preferable upper limit value for the V content is 0.200%, 0.150%, or 0.100%.

Furthermore, in addition to the above compositions, the high strength hot press-formed part according to the present embodiment may contain B: 0.0001% to 0.1000%. However, B is not an essential composition. Even in a case where B is not contained, the part according to the present embodiment can solve the problem. Therefore, the lower limit value for the B content is 0%.

(B: 0% to 0.1000%)

Boron (B) is an element which is effective in improving strength of grain boundaries, high-strengthening of a steel, and the like. In order to achieve these effects, the lower limit value for the B content may be set to 0.0001%. On the other hand, if the B content exceeds 0.1000%, there are cases where not only the above effects are saturated but also manufacturability at the time of hot rolling of a steel sheet is hindered. Due to the above reasons, the B content is preferably set to 0.0001% or more and 0.1000% or less. A more preferable lower limit value for the B content is 0.0003%, 0.0005%, or 0.0007%. A more preferable upper limit value for the B content is 0.0100%, 0.0080%, or 0.0060%.

Moreover, in addition to the above compositions, the high strength hot press-formed part according to the present embodiment may contain at least one of Ca: 0.0005% to 0.0100%, Mg: 0.0005% to 0.0100%, and REM: 0.0005% to 0.0100%. However, these elements are not essential elements. Even in a case where these elements are not contained, the part according to the present embodiment can solve the problem. Therefore, the lower limit value for the amounts of these elements is 0%.

(Ca: 0% to 0.0100%)

(Mg: 0% to 0.0100%)

(REM: 0% to 0.0100%)

Ca, Mg, and rare earth metal (REM) are elements which are effective in deoxidation of a steel sheet. In order to achieve this effect, a part may contain at least one selected from the group consisting of Ca of 0.0005% or more, Mg of 0.0005% or more, and REM of 0.0005% or more. On the other hand, if each of Ca content, Mg content, and REM content exceeds 0.0100%, formability of a part is hindered. Due to the above reasons, each of Ca content, Mg content, and REM content is preferably set to 0.0005% or more and 0.0100% or less. A more preferable lower limit value for each of the Ca content, the Mg content, and the REM content is 0.0010%, 0.0020%, or 0.0030%. A more preferable upper limit value for each of the Ca content, the Mg content, and the REM content is 0.0090%, 0.0080%, or 0.0070%. In addition, in a case where a part contains at least two selected from the group consisting of Ca, Mg, and REM, the total of the Ca content, the Mg content, and the REM content is preferably set to 0.0010% or more and 0.0250% or less.

The term "REM" indicates 17 elements in total consisting of Sc, Y, and lanthanoid, and the "amount of REM" denotes the total amount of these 17 elements. REM can be added in a form of a misch metal (an alloy including a plurality of rare earth elements). There are cases where a misch metal contains a lanthanoid-based element in addition to La and Ce. As impurities, the high strength hot press-formed part according to the present embodiment may contain a lanthanoid-based element other than La and Ce. In addition, the high strength hot press-formed part according to the present embodiment can contain La and Ce within a range not hindering various properties (particularly, ductility and bendability) of the part.

(Remainder: Fe and Impurities)

The remainder of the chemical composition of the part according to the present embodiment includes Fe and impurities. Impurities are compositions included in a raw material of a part or compositions incorporated during a process of manufacturing a part. Impurities indicate elements which do not affect various properties of a part. Specifically, examples of impurities include P, S, O, Sb, Sn, W, Co, As, Pb, Bi, and H. Among these, P, S, and O are required to be controlled as described above. In addition, according to an ordinary manufacturing method, Sb, Sn, W, Co, and As within a range of 0.1% or less; Pb and Bi within a range of 0.010% or less; and H within a range of 0.0005% or less can be incorporated in a steel as impurities. If these elements are within these range, it is not particularly necessary to control the contents thereof.

In addition, Si, Al, Cr, Mo, V, and Ca which are elements for the high strength cold-rolled steel sheet of the present embodiment can be unintentionally incorporated as impurities. However, if these compositions are within the range described above, the compositions do not adversely affect various properties of the high strength hot press-formed part according to the present embodiment. Moreover, generally, N is sometimes handled as impurities in a steel sheet. However, in the part according to the present embodiment, N is preferably controlled within the range described above.

[Microstructure]

Next, the reasons for limiting the microstructure of the high strength hot press-formed part according to the present embodiment will be described. In this specification, the unit "%" for the proportion of each of the structures denotes a "volume fraction (vol %)". In addition, the microstructure of the part according to the present embodiment is defined in a ¼ portion of a part. The reason is that a ¼ portion positioned between the rolled surface and a central plane has a typical configuration of a part. In this specification, unless otherwise stated particularly, description related to a microstructure relates to the microstructure of a ¼ portion. In addition, the part according to the present embodiment has a place subjected to working and a place not subjected to working. Both the microstructures thereof are substantially the same as each other.

(Tempered Martensite: 20% to 90%)

Tempered martensite is a structure strengthening a steel and is a structure included to ensure the strength of the part according to the present embodiment. If the volume fraction of tempered martensite is less than 20%, strength of a part is insufficient. On the other hand, if the volume fraction of tempered martensite exceeds 90%, bainite and austenite necessary to ensure the ductility and the bendability of a part are insufficient. Due to the above reasons, the volume fraction of tempered martensite is set to 20% or more and 90% or less. A preferable lower limit value for the volume fraction of tempered martensite is 25%, 30%, or 35%. A preferable upper limit value for the volume fraction of tempered martensite is 85%, 80%, or 75%.

(Bainite: 5% to 75%)

Bainite is an important structure for improving bendability of a part. Generally, in a case where a part has a structure constituted of full hard martensite and residual austenite having excellent ductility, stress concentration toward martensite occurs at the time of deformation of a part, due to the hardness difference between the martensite and the residual austenite. Due to this stress concentration, voids are formed in the interface between the martensite and the residual austenite. As a result, there is concern that bendability of a part will be deteriorated. However, in a case where a part has a structure including bainite in addition to martensite and residual austenite, the bainite reduces the hardness difference between the structures. Accordingly, stress concentration toward martensite is alleviated, and bendability of a part is improved.

If the volume fraction of bainite is less than 5%, stress concentration toward martensite is not sufficiently alleviated, so that ensuring excellent bendability cannot be realized. On the other hand, if the volume fraction of bainite exceeds 75%, martensite and residual austenite necessary to ensure the strength and the ductility of a part are insufficient. Due to the above reasons, the volume fraction of bainite is set to 5% or more and 75% or less. A preferable lower limit value for the volume fraction of bainite is 10%, 15%, or 20%. A preferable upper limit value for the volume fraction of bainite is 70%, 65%, or 60%.

(Residual Austenite: 5% to 25%)

Residual austenite is an important structure for ensuring the ductility of a part. Residual austenite is transformed to martensite at the time of press forming of a steel sheet, so that the steel sheet is provided with excellent work hardening and highly uniform elongation. If the volume fraction of residual austenite is less than 5%, uniform elongation cannot be sufficiently achieved, so that it is difficult to ensure excellent formability. On the other hand, if the volume fraction of residual austenite exceeds 25%, martensite and bainite necessary to ensure the strength and the hole expansion ratio of a steel sheet are insufficient. Due to the above reasons, the volume fraction of residual austenite is set to 5% or more and 25% or less. A preferable lower limit value for the volume fraction of residual austenite is 7%, 10%, or 12%. A preferable upper limit value for the volume fraction of residual austenite is 22%, 20%, or 18%.

(Ferrite: 0% to 10%)

Ferrite is a soft structure. Therefore, it is preferable that its volume fraction is minimized as much as possible. Therefore, the lower limit value for the volume fraction of ferrite is 0%. If the volume fraction of ferrite exceeds 10%, it is difficult to ensure the strength of a steel sheet. Therefore, the volume fraction of ferrite is limited to 10% or less. A preferable upper limit value for the volume fraction of ferrite is 8%, 5%, or 3%.

Identification, verification of the existence position, and measurement of the volume fraction for tempered martensite, bainite, residual austenite, and ferrite can be performed by corroding a cross section parallel to the rolling direction of a steel sheet and perpendicular to the rolled surface or a cross section perpendicular to the rolling direction and the rolled surface of a steel sheet using an etchant (pretreatment liquid) constituted of a mixed solution of a nital reagent, a LePera reagent, picric acid, ethanol, sodium thiosulfate, citric acid, and nitric acid, and an etchant (post-treatment liquid) constituted of a mixed solution of nitric acid and ethanol, and by observing the corroded cross section using an optical microscope having a magnification of 1,000 and a scanning electron microscope and a transmission electron microscope having a magnification of 1,000 to 100,000.

In identification of tempered martensite, a cross section was observed using a scanning electron microscope and a transmission electron microscope. Martensite including carbide, which contained much Fe inside the carbide (Fe-based carbide), was regarded as tempered martensite, and martensite which did not include the carbide was regarded as ordinary martensite which was not tempered (fresh martensite). Carbide of various crystal structures could be adopted as carbide containing much Fe. However, martensite including Fe-based carbide of any crystal structure was considered to be corresponding to the tempered martensite of the present embodiment. In addition, the tempered martensite of the present embodiment included elements in which a plurality of kinds of Fe-based carbide were mixed due to heat treatment conditions.

In addition, identification of tempered martensite, bainite, residual austenite, and ferrite can also be performed through analysis of the crystal orientation by a crystal orientation analysis method (FE-SEM-EBSD method) using electron back-scatter diffraction (EBSD) which belongs to a field emission scanning electron microscope (FE-SEM), or hardness measurement of a micro area, such as micro-Vickers hardness measurement.

For example, during verification of the volume fraction (%) of residual austenite in a metallographic structure, X-ray analysis may be performed with an approximately ¼ depth position plane in the sheet thickness of a part parallel to the rolled surface of a part (an approximately ¼ depth plane in the thickness from the rolled surface of a part) as an observed section. The area fraction of residual austenite obtained through the analysis is regarded as the volume fraction of residual austenite.

In contrast, during verification of the volume fraction (%) of bainite, tempered martensite, and ferrite in a metallographic structure, first, a cross section parallel to the rolling direction of a steel sheet and perpendicular to the rolled surface (observed section) is polished and is etched using a nital solution. Subsequently, a thickness ¼ portion of the etched cross section is observed using an FE-SEM, and the area fraction of each of the structures is measured. The area fraction obtained in this case is a value substantially equal to the volume fraction. Therefore, this area fraction is regarded as the volume fraction.

In observation using an FE-SEM, for example, each of the structures in a square observed section having a side of 30 μm can be distinguished and recognized as follows. That is, tempered martensite is aggregation of grains in a lath state (a plate shape having a particular preferential growth direction). The above-described Fe-based carbide having a major axis of 20 nm or longer is included inside the grains, and the tempered martensite can be recognized as structures which belong to a plurality of Fe-based carbide groups and in which the carbide is stretched into a plurality of variants (that is, in different directions). Bainite is aggregation of grains in a lath state and can be recognized as structures which belong to the Fe-based carbide groups, and which do not include Fe-based carbide having a major axis of 20 nm or longer inside the grains or which include Fe-based carbide having a major axis of 20 nm or longer inside the grains but in which the carbide is stretched into a single variant (in the same direction). Here, Fe-based carbide groups stretched in the same direction denote that the difference among Fe-based carbide groups in a stretching direction is within 5°. Ferrite is constituted of ingot-shaped grains and can be recognized as structures which do not include Fe-based carbide having a major axis of 100 nm or longer inside the grains.

Tempered martensite and bainite can be easily distinguished from each other by observing the Fe-based carbide inside the grains in a lath state using an FE-SEM, and examining the stretching direction.

[Pole density of orientation {211}<011> in thickness ¼ portion] Next, the reasons for limiting the pole density of the high strength hot press-formed part according to the present embodiment will be described. The pole density of the part according to the present embodiment is defined in a ¼ portion of the part having a typical configuration of a part. In this specification, unless otherwise stated particularly, description related to a pole density relates to the pole density in a ¼ portion. In addition, the part according to the present embodiment has a place subjected to working and a place not subjected to working. Both the pole densities thereof are substantially the same as each other.

In a case where the pole density of the orientation {211}<011> in the thickness ¼ portion of a hot pressed part is lower than 3.0, both the r value for the rolling direction and the r value for the transvers direction cannot be 0.80 or smaller, so that bendability deteriorates. Therefore, the pole density of the orientation {211}<011> in the thickness ¼ portion is set to 3.0 or higher. The lower limit value for the pole density of the orientation {211}<011> in the thickness ¼ portion is preferably 4.0 or 5.0. The upper limit value for the pole density of the orientation {211}<011> in the thickness ¼ portion is not particularly defined. However, in a case where the pole density of the orientation {211}<011> in the thickness ¼ portion exceeds 15.0, there are cases where formability of a part deteriorates. Therefore, the pole density of the orientation {211}<011> in the thickness ¼ portion may be set to 15.0 or lower, or 12.0 or lower.

A pole density is the ratio of an integration degree of a test piece in a particular orientation with respect to a standard sample having no integration in a particular orientation. The pole density of the orientation {211}<011> in the thickness ¼ portion of the part according to the present embodiment is measured by an electron back scattering diffraction pattern (EBSD) method.

Measurement of the pole density using an EBSD is performed as follows. A cross section parallel to the rolling direction of a part and perpendicular to the rolled surface is set as an observed section. In the observed section, EBSD analysis is performed, at a measurement interval of 1 μm, with respect to a rectangular region of 1,000 μm in the rolling direction and 100 μm in a rolled surface normal direction having a line at a ¼ depth in a sheet thickness t from a surface of the part, as the center, and crystal orientation information of this rectangular region is acquired. The EBSD analysis is performed at an analysis rate of 200 points/sec to 300 points/sec using a device constituted of a thermal field emission scanning electron microscope (for example, JSM-7001F manufactured by JEOL) and an EBSD detector (for example, a detector HIKARI manufactured by TSL). From the crystal orientation information of this rectangular region, an orientation distribution function (ODF) of this rectangular region is calculated using EBSD analysis software "OIM Analysis" (registered trademark). Accordingly, the pole density of each crystal orientation can be calculated, so that the pole density of the orientation {211}<011> in the thickness ¼ portion of the part can be obtained.

FIG. 1 is a view illustrating a position of a main crystal orientation on an ODF ($\phi2=45°$ cross section). Generally, a crystal orientation perpendicular to the rolled surface is expressed by a sign (hkl) or {hkl}, and a crystal orientation parallel to the rolling direction is expressed by a sign [uvw] or <uvw>. The signs {hkl} and <uvw> are generic tenns of equivalent planes and orientations, and (hkl) and [uvw] each indicates an individual crystal plane.

The crystal structure of the part of the present embodiment is mainly a body centered cubic structure (bcc structure). Therefore, for example, (111), (−111), (1−11), (11−1), (−1−11), (−11−1), (1−1−1), and (−1−1−1) are substantially equivalent to each other and cannot be distinguished from each other. In the present embodiment, the orientations will be collectively expressed as {111}.

The ODF is also used for expressing a crystal orientation of a crystal structure having low symmetry. Generally, it is expressed as $\phi1=0°$ to 360°, $\Phi=0°$ to 180°, and $\phi2=0°$ to 360°, and each crystal orientation is expressed as (hkl)[uvw]. However, the crystal structure of the hot rolled steel sheet of the present embodiment is a body centered cubic structure having high symmetry. Therefore, $\Phi$ and $\phi2$ can be expressed with 0° to 90°.

The value of $\phi1$ varies depending on whether or not symmetry due to deformation is taken into consideration when calculation is performed. In the present embodiment, calculation considering the symmetry (orthotropic) is performed, and the result is expressed as $\phi1=0°$ to 90°. That is, in measurement of the pole density of the part according to the present embodiment, a method of expressing an average value of the same orientations of $\phi1=0°$ to 360° on the ODF of 0° to 90° is selected. In this case, (hkl)[uvw] and {hkl}<uvw> are synonymous with each other. Therefore, the pole density of an orientation (112)[1−10] ($\phi1=0°$ and $\Phi=35°$) of the ODF on $\phi2=45°$ cross section illustrated in FIG. 1 is synonymous with the pole density of the orientation {211}<011>.

It is possible to realize a high strength hot press-formed part having excellent fatigue resistance and durability as well as excellent ductility while having the tensile product of the part of 26,000 (MPa·%) or greater by adjusting the composition, the structure, and the pole density of the part as described above. In addition, due to the adjustment, it is possible to realize a part having excellent bendability while both the r value for the rolling direction of the part and the r value for the transvers direction of the part are 0.80 or smaller, and both the limitation of bending of the part in the rolling direction and the limitation of bending of the part in the transvers direction are 2.0 or smaller.

As the r value is reduced, deformation in the sheet thickness direction is promoted when an impact is received, so that bending cracking can be prevented. Generally, in a case where the r value for a direction perpendicular to a ridge direction of bending is 0.80 or smaller, the effect of preventing bending cracking is exhibited at a high level. In the high strength hot press-formed part according to the present embodiment, since both the r value for the rolling direction and the r value for the transvers direction are 0.80 or smaller, even if a part receives significant bending deformation at the time of collision, the part can exhibit excellent bendability.

<Method of Manufacturing High Strength Hot Press-Formed Part>

Next, a method of manufacturing the high strength hot press-formed part according to the present embodiment will be described in detail. In this method of manufacturing a high strength hot press-formed part, a heating step of heating a hot pressing element sheet which is a cold-rolled steel sheet or an annealed steel sheet consisting of the chemical compositions described above and in which the maximum heating temperature is equal to or higher than an $Ac_3$ point, and a hot press forming and cooling step of hot press forming of a hot pressing element sheet and cooling the hot pressing element sheet to a temperature range of (Ms point−250° C.) to the Ms point at the same time are sequentially performed as essential steps. In addition, in the method of manufacturing a high strength hot press-formed part of the present embodiment, separately from these steps, a reheating step of reheating the part to a temperature range of 300° C. to 500° C., successively retaining the part within the reheating temperature range for 10 to 1,000 seconds, and then cooling the part at room temperature is performed in an optionally selective manner after the hot press forming and cooling step. Hereinafter, each of the steps will be described. In the following description, a step of preparing a hot pressing element sheet performed before the heating step will also be mentioned as well.

In description of the method of manufacturing the part according to the present embodiment, a "heating speed" and a "cooling rate" denote a fraction dT/dt (instantaneous rate at time t) obtained by differentiating a temperature T with the time t. For example, the description of "the heating speed within a temperature range of A° C. to B° C. is set to X° C./sec to Y° C./sec" denotes that the fraction dT/dt while the temperature T changes from A° C. to B° C. is within a range of X° C./sec to Y° C./sec at all times.

(Step of Preparing Hot Pressing Element Sheet)

This step is a preparation step of obtaining a hot pressing element sheet (a cold-rolled steel sheet or an annealed steel sheet) used in the heating step described below. Each step of manufacturing treatment preceding casting is not particularly limited. That is, various kinds of secondary refining may be performed subsequently to smelting using a blast furnace, an electric furnace, or the like. A cast slab may be cooled to a low temperature once, reheated, and subjected to hot rolling, or may be continuously (that is, without being cooled and reheated) subjected to hot rolling. In hot rolling, it is important that the total rolling reduction within a temperature region of 920° C. or lower is set to 25% or more. The reasons are as follows.

(1) In rolling temperature region exceeding 920° C., recrystallization proceeds during the rolling or during a time until the next rolling. Therefore, it is difficult for strain to be accumulated in a steel. As a result, there is a possibility that such rolling will not sufficiently contribute to forming of textures.

(2) In a case where the total rolling reduction within a temperature region of 920° C. or lower is less than 25%, a crystal rotation effect due to rolling cannot be sufficiently achieved. Therefore, there is a possibility that textures will not be sufficiently formed.

Due to these reasons, it is important that the total rolling reduction within a temperature region of 920° C. or lower is set to 25% or more. The total rolling reduction within a temperature region of 920° C. or lower is preferably 30% or more and is more desirably 40% or more. On the other hand, the upper limit for the total rolling reduction within a temperature region of 920° C. or lower is desirably set to 80%. The reason is that if rolling exceeding 80% is performed, an increase in a load to a rolling roll is caused and affects durability of a rolling mill. A scrap may be used as a raw material of a hot pressing element sheet.

In addition, as a cooling condition after hot rolling, it is possible to employ a cooling pattern for controlling a structure to exhibit each of the effects (excellent ductility and bendability) of the part according to the present embodiment.

A coiling temperature is preferably set to 650° C. or lower. If a hot rolled steel sheet is coiled at a temperature exceeding 650° C., pickling properties deteriorate due to an excessively increased thickness of oxide formed on a surface of the hot rolled steel sheet. The coiling temperature is more preferably set to 600° C. or lower. The reason is that bainitic transformation is likely to occur within a temperature range of 600° C. or lower. If the structure of a hot rolled sheet is mainly constituted of bainite, textures are sufficiently formed during the successive cold rolling, so that a desired r value is easily obtained.

Each of the effects (excellent ductility and bendability) of the part according to the present embodiment is exhibited without particularly limiting the lower limit value for the coiling temperature. However, since it is technologically difficult to coil a hot rolled steel sheet at a temperature equal to or lower than the room temperature, the room temperature becomes the substantial lower limit value for the coiling temperature. However, if the coiling temperature is lower than 350° C., the proportion of full hard martensite increases in the structure of a hot rolled sheet, and it is difficult to perform cold rolling. Therefore, the coiling temperature is preferably set to 350° C. or higher.

The hot rolled steel sheet manufactured in this manner is subjected to pickling. The number of times of pickling is not particularly defined.

The pickled hot rolled steel sheet is subjected to cold rolling at the total rolling reduction of 50% to 90%, thereby obtaining a hot pressing element sheet. In order to cause both the r value for the rolling direction and the r value for the transvers direction of the high strength hot press-formed part according to the present embodiment to be 0.80 or smaller, the pole density of the orientation {211}<011> in the thickness ¼ portion of the hot pressing element sheet is required to be 3.0 or higher. The pole density of the orientation {211}<011> in the thickness ¼ portion of the hot pressing element sheet is desirably 4.0 or higher and is more desirably 5.0 or higher. In a case where the total rolling reduction of cold rolling is less than 50%, the pole density of the orientation {211}<011> in the thickness ¼ portion of the hot pressing element sheet becomes less than 3.0. Accordingly, the textures of the part cannot be controlled as described above, so that it is difficult to ensure a desired r value.

On the other hand, if the total rolling reduction of cold rolling exceeds 90%, a driving force of recrystallization excessively increases. Accordingly, ferrite is recrystallized during the heating step of hot pressing described below. In the heating step of hot pressing described below, a hot pressing element sheet is heated to a temperature equal to or higher than the $Ac_3$ point. However, unrecrystallized ferrite is required to remain in the hot pressing element sheet until the temperature reaches the $Ac_3$ point. In a case where the total rolling reduction of cold rolling exceeds 90%, this condition is no longer achieved. In addition, if the total rolling reduction exceeds 90%, a cold rolling load excessively increases, and it is difficult to perform cold rolling. A total rolling reduction r of cold rolling is obtained by substituting the following Expression 1 with a sheet thickness $h_1$ (mm) after cold rolling ends, and a sheet thickness $h_2$ (mm) before cold rolling starts.

$$r=(h_2-h_1)/h_2 \quad \text{(Expression 1)}$$

Due to the above reasons, the total rolling reduction of cold rolling for a pickled hot rolled steel sheet is set to 50% or more and 90% or less. A preferable range for the total rolling reduction of cold rolling is 60% or more and 80% or less. In addition, the number of times of rolling passes and the rolling reduction for each pass are not particularly limited.

In addition, an annealed steel sheet, which is realized by performing heat treatment (annealing) to a cold-rolled steel sheet obtained through the cold rolling may be adopted as a hot pressing element sheet. Heat treatment is not particularly limited and may be performed by a method of passing a sheet through a continuous annealing line or may be performed through batch annealing. During heat treatment, the heating speed is required to be 10° C./sec or faster within a temperature range of 500° C. or higher and an $Ac_1$ point or lower. In a case where the heating speed is slower than 10° C./sec, the textures of an ultimately obtained formed product are not preferably controlled. However, in a case where the sum of the Ti content and the Nb content of a steel sheet is 0.005 mass % or greater, the heating speed need only be 3° C./sec or faster at all times within a temperature range of 500° C. or higher and the $Ac_1$ point or lower.

An annealing temperature is preferably set to the $Ac_1$ point or higher and the $Ac_3$ point or lower. The reason is that recrystallization of ferrite proceeds if the annealing temperature is lower than the $Ac_1$ point. On the other hand, if the annealing temperature exceeds the $Ac_3$ point, the steel sheet has austenite single phase structures, and it is difficult to cause unrecrystallized ferrite to remain. In any of the cases, it is difficult for unrecrystallized ferrite to remain in a hot pressing element sheet until the hot pressing element sheet reaches the $Ac_3$ point in the heating step of hot pressing.

The annealing time within this temperature range ($Ac_1$ point or higher and the $Ac_3$ point or lower) is not particularly limited. However, the annealing time exceeding 600 seconds is not economically preferable due to a cost rise. The annealing time indicates the length of a period during which the temperature of a steel sheet is isothermally retained at the highest temperature (annealing temperature). During this period, a steel sheet may be isothermally retained or may be cooled immediately after the temperature reaches the maximum heating temperature.

In cooling after annealing, the cooling start temperature is preferably set to 700° C. or higher, the cooling end temperature is set to 400° C. or lower, and the cooling rate within a temperature range of 700° C. to 400° C. is set to 10° C./sec or faster. If the cooling rate within the temperature range of 700° C. to 400° C. is slower than 10° C./sec, recrystallization of ferrite proceeds. In this case, it is difficult for unrecrystallized ferrite to remain in a hot pressing element sheet until the hot pressing element sheet reaches the $Ac_3$ point in the heating step of hot pressing.

(Heating Step)

This step is a step of heating a hot pressing element sheet which is a cold-rolled steel sheet or an annealed steel sheet obtained via the preparation step to the $Ac_3$ point or higher. The maximum heating temperature of a hot pressing element sheet is set to the $Ac_3$ point or higher. If the maximum heating temperature is lower than the $Ac_3$ point, a large amount of ferrite is generated in a high strength hot press-formed part, so that it is difficult to ensure the strength of the high strength hot press-formed part. For this reason, the $Ac_3$ point is set as the lower limit for the maximum heating temperature. On the other hand, heating at an excessively high temperature is not economically preferable due to a cost rise and induces troubles such as deterioration of the life-span of a pressing die. Therefore, the maximum heating temperature is preferably set to the $Ac_3$ point+50° C. or lower.

In heating to the maximum heating temperature, the heating speed within the temperature range of 500° C. to the $Ac_1$ point is preferably set to 10° C./sec or faster. However, in a case where the total value of the Ti content and the Nb content of a hot-pressed element sheet is 0.005 mass % or more, the heating speed can be set to 3° C./sec or faster. If the heating speed within the temperature range of 500° C. to the $Ac_1$ point is slower than 10° C./sec, recrystallization of ferrite occurs during heating, so that it is difficult to cause unrecrystallized ferrite to remain until the temperature reaches the $Ac_3$ point. In addition, coarsening of austenite grains can be minimized by heating at the heating speed of 10° C./sec or faster, so that toughness and delayed fracture resistance properties of a high strength hot press-formed part can be improved.

In this manner, unrecrystallized ferrite can remain until the temperature reaches the $Ac_3$ point and productivity of high strength hot press-formed parts can be improved by increasing the heating speed within the temperature range of 500° C. to the $Ac_1$ point. However, if the heating speed within the temperature range of 500° C. to the $Ac_1$ point exceeds 300° C./sec, these effects are in a saturated state, so that any special effect is not achieved. Thus, the upper limit for the heating speed is preferably set to 300° C./sec.

The retention time at the maximum heating temperature is not particularly limited. For dissolution of carbide, the retention time is preferably set to 20 seconds or longer. On the other hand, in order to cause the textures which are preferable to obtain a desired r value to remain, the retention time is preferably set to be shorter than 100 seconds.

(Hot Pressing Step)

In a hot pressing step, a hot pressing element sheet which has passed through the heating step is subjected to hot press forming using a hot press forming unit (for example, a die). At the same time, the hot pressing element sheet is cooled to a temperature range of (Ms point−250° C.) to the Ms point using a cooling unit or the like (for example, a refrigerant flowing in a conduit line inside the die) provided in the hot press forming unit. For hot press forming, any known method can be used.

In the hot pressing step, martensite is generated by cooling the part to the temperature range of (Ms point−250° C.) or higher and the Ms point or lower at a cooling rate of 0.5° C./sec to 200° C./sec. If the cooling stop temperature is lower than (Ms point−250° C.), martensite is excessively generated, so that ensuring the ductility and the bendability of the high strength hot press-formed part is not sufficiently achieved. In contrast, if the cooling stop temperature is higher than the Ms point, martensite is not sufficiently generated, so that ensuring the strength of the high strength hot press-formed part is not sufficiently achieved. Thus, the cooling stop temperature is set to (Ms point−250° C.) or higher and the Ms point or lower. In a case where the atmosphere temperature is low, even if the operation of the cooling unit is stopped, the temperature falling rate of the part becomes 0.5° C./sec or faster, so that stopping the cooling described above is not achieved. In this case, the temperature falling rate of the part is required to be minimized to be slower than 0.5° C./sec by suitably using a heating unit such that stopping the cooling described above is achieved. In addition, in a case where the cooling stop temperature is set to (Ms point−220° C.) or higher and (Ms point−50° C.) or lower, each of the effects described above is exhibited at a high level, which is preferable.

The cooling rate from the maximum heating temperature to the cooling stop temperature is not particularly limited. The cooling rate is preferably set to a range of 0.5° C./sec to 200° C./sec. if the cooling rate is slower than 0.5° C./sec, austenite is transformed to a pearlite structure during the cooling process, or a large amount of ferrite is generated, so that it is difficult to ensure a sufficient volume percentage of martensite and bainite for ensuring the strength.

On the other hand, even if the cooling rate is increased, there is not any problem in regard to the material of a high strength hot press-formed part. However, an excessively increased cooling rate results in a high manufacturing cost. Therefore, the upper limit for the cooling rate is preferably set to 200° C./sec.

(Reheating Step)

The reheating step is a step of reheating a part which has passed through the hot press forming and cooling step within a temperature range of 300° C. to 500° C., subsequently retaining the part within the reheating temperature range for 10 seconds to 1,000 seconds, and then cooling the part from the reheating temperature range to the room temperature. The reheating can be performed through energization heating or induction heating. The reheating step is an optionally selective step, and retention in the reheating step includes not only isothermal retention but also slow cooling and heating within the temperature range described above. Therefore, the retention time in the reheating step denotes the length of a period during which a part is within the reheating temperature range.

If the reheating temperature (retention temperature) is lower than 300° C., bainitic transformation requires a long period of time, so that excellent productivity cannot be realized. On the other hand, if the reheating temperature (retention temperature) exceeds 500° C., bainitic transformation is unlikely to occur. Thus, the reheating temperature is set to a range of 300° C. to 500° C. A preferable range for the reheating temperature is a range of 350° C. or higher and 450° C. or lower.

In addition, if the retention time is less than 10 seconds, bainitic transformation does not sufficiently proceed, so that it is not possible to obtain sufficient bainite for ensuring the bendability and sufficient residual austenite for ensuring the ductility. On the other hand, if the retention time exceeds 1,000 seconds, decomposition of residual austenite occurs, and residual austenite effective in ensuring the ductility cannot be achieved, so that productivity is deteriorated. Thus, the retention time is set to 10 seconds or longer and 1,000 seconds or shorter. A preferable range for the retention time is 100 seconds or longer and 900 seconds or shorter.

Moreover, the cooling form after the retention is not particularly limited. A part need only be cooled to the room temperature while being retained inside a die. Since this step is an optionally selective step, in a case where this step is not employed, after the hot press forming step ends, a part may be taken out from the pressing die and may be mounted in a furnace heated to a temperature of 300° C. to 500° C. As long as these thermal histories are satisfied, a steel sheet may be subjected to heat treatment using any equipment.

In principle, the method of manufacturing a high strength hot press-formed part of the present embodiment described above is to pass through each of the steps such as refining, steel-manufacturing, casting, hot rolling, and cold rolling in ordinary steel manufacturing. However, as long as the conditions of each step described above are satisfied, even if the design is suitably changed, the effects of the high strength hot press-formed part according to the present embodiment can be achieved.

EXAMPLES

Hereinafter, the effects of the present invention will be specifically described based on examples of the invention. The present invention is not limited to the conditions used in the following examples of the invention.

Steel sheets A1 to d1 were manufactured by sequentially performing steps, which simulate the step of manufacturing the hot pressing element sheet of the present invention, the heating step, the hot press forming step, the cooling step, and the reheating step, with respect to cast pieces A to R, and a to d each having the chemical composition shown in Table 1 under the conditions shown in Tables 2-1 to 3-3. Thereafter, the steel sheets were cooled to the room temperature. The steel sheets A1 to dl obtained from each of the test examples were not subjected to hot pressing using a die. However, mechanical properties of the obtained steel sheets were substantially the same as those of an unprocessed portion of a hot press-formed part having the same thermal history. Therefore, the effects of the hot press-formed part of the present invention could be verified by evaluating the obtained steel sheets A1 to d1.

Here, the kinds of steels A to R in Table 1 were the kinds of steel having a composition defined in the present invention, and the kinds of steels a to d were the kind of steel in which the amount of at least any of C, Si, and Mn was out of the range of the present invention. In addition, alphabets included in the test signs disclosed in Table 2-1 and the like corresponded to the kinds of steel disclosed in Table 1. In order to distinguish the test examples from each other, a numerical suffix was attached to the alphabet. For example, in Table 2-1, the chemical compositions of the test signs D1 to D18 were the chemical composition of the kind of steel D in Table 1. Moreover, in Table 1, and Tables 2-1 to 3-3, the underlined numerical values were numerical values out of the defined range of the present invention. The "retention time at 300° C. to 500° C." of D7, D13, H6, K12, L6, L12, and L13 was the isothermal retention time at the reheating temperature disclosed as the "retention temperature (° C.) of 300° C. to 500° C.", and the "retention time at 300° C. to 500° C." of Examples other than those above was the period of time during which the temperature of the steel sheet was within a range of 300° C. to 500° C.

In addition, the $Ac_3$ point and the Ms point of each of the test examples were values obtained by measuring hot pressing element sheets subjected to hot rolling and cold rolling, in advance at a laboratory. Then, the annealing temperature and the cooling temperature were set using the $Ac_3$ point and the Ms point obtained in this manner.

TABLE 1

| | | Chemical composition (unit mass %, remainder: Fe and impurities) | | | | | | | | | |
|---|---|---|---|---|---|---|---|---|---|---|---|
| | | C | Si | Mn | P | S | N | Al | O | Mo | Cr |
| Steels of invention | A | 0.243 | 1.16 | 2.38 | 0.011 | 0.0029 | 0.0027 | 0.040 | 0.0012 | — | — |
| | B | 0.415 | 2.07 | 2.27 | 0.010 | 0.0023 | 0.0032 | 0.241 | 0.0011 | — | — |
| | C | 0.284 | 1.46 | 4.75 | 0.012 | 0.0028 | 0.0041 | 0.020 | 0.0022 | — | — |
| | D | 0.270 | 1.12 | 2.39 | 0.009 | 0.0019 | 0.0024 | 1.200 | 0.0019 | 0.03 | — |
| | E | 0.324 | 1.19 | 2.34 | 0.010 | 0.0031 | 0.0033 | 0.024 | 0.0023 | 0.02 | 0.35 |
| | F | 0.214 | 1.64 | 3.51 | 0.007 | 0.0024 | 0.0030 | 0.023 | 0.0010 | — | 0.42 |
| | G | 0.284 | 1.87 | 4.24 | 0.010 | 0.0025 | 0.0025 | 0.031 | 0.0029 | — | — |

TABLE 1-continued

| | | Chemical composition (unit mass %, remainder: Fe and impurities) | | | | | | | | | |
|---|---|---|---|---|---|---|---|---|---|---|---|
| | H | 0.234 | 1.57 | 2.72 | 0.013 | 0.0018 | 0.0026 | 0.024 | 0.0014 | — | — |
| | I | 0.496 | 1.65 | 1.86 | 0.014 | 0.0017 | 0.0027 | 0.027 | 0.0021 | — | — |
| | J | 0.454 | 1.34 | 2.33 | 0.009 | 0.0030 | 0.0023 | 0.027 | 0.0031 | — | — |
| | K | 0.267 | 2.46 | 1.67 | 0.009 | 0.0026 | 0.0028 | 0.019 | 0.0022 | — | — |
| | L | 0.246 | 1.64 | 1.79 | 0.011 | 0.0022 | 0.0024 | 0.014 | 0.0016 | — | — |
| | M | 0.170 | 1.57 | 2.22 | 0.011 | 0.0028 | 0.0031 | 0.021 | 0.0023 | — | — |
| | N | 0.304 | 1.55 | 2.09 | 0.013 | 0.0064 | 0.0019 | 0.009 | 0.0027 | — | — |
| | O | 0.352 | 1.43 | 2.19 | 0.010 | 0.0052 | 0.0024 | 0.013 | 0.0025 | — | — |
| | P | 0.243 | 1.64 | 2.22 | 0.014 | 0.0024 | 0.0025 | 0.011 | 0.0031 | — | — |
| | Q | 0.134 | 1.85 | 4.92 | 0.012 | 0.0031 | 0.0026 | 0.009 | 0.0017 | — | — |
| | R | 0.112 | 1.49 | 2.28 | 0.009 | 0.0021 | 0.0027 | 0.007 | 0.0027 | — | — |
| Comparative Steels | a | 0.086 | 0.75 | 2.03 | 0.015 | 0.0032 | 0.0021 | 0.032 | 0.0020 | — | — |
| | b | 0.075 | 7.52 | 2.09 | 0.011 | 0.0042 | 0.0023 | 0.024 | 0.0019 | — | — |
| | c | 0.260 | 0.74 | 2.42 | 0.013 | 0.0009 | 0.0025 | 0.019 | 0.0014 | — | — |
| | d | 0.092 | 0.49 | 5.26 | 0.009 | 0.0037 | 0.0022 | 0.026 | 0.0015 | — | — |

| | | Cu | Ni | Ti | Nb | V | B | Mg | Rem | Ca |
|---|---|---|---|---|---|---|---|---|---|---|
| Steels of invention | A | — | — | — | — | — | — | — | — | — |
| | B | — | — | — | — | — | — | — | — | — |
| | C | — | — | — | — | — | — | — | — | — |
| | D | — | — | — | — | — | — | — | — | — |
| | E | — | — | — | — | — | — | — | — | — |
| | F | — | — | — | — | — | — | — | — | — |
| | G | 0.32 | — | — | — | — | — | — | — | — |
| | H | — | 1.20 | — | — | — | — | — | — | — |
| | I | 0.37 | 0.94 | 0.047 | — | — | — | — | — | — |
| | J | — | — | 0.052 | — | — | — | — | — | — |
| | K | — | — | 0.042 | 0.021 | — | — | — | — | — |
| | L | — | — | — | 0.027 | — | — | — | — | — |
| | M | — | — | — | 0.019 | — | 0.0015 | — | — | — |
| | N | — | — | — | — | 0.041 | — | — | — | — |
| | O | — | — | — | — | — | 0.0021 | — | — | — |
| | P | — | — | — | — | — | — | 0.0013 | — | — |
| | Q | — | — | — | — | — | — | — | 0.0008 | — |
| | R | — | — | — | — | — | — | — | — | 0.0006 |
| Comparative Steels | a | — | — | — | — | — | — | — | — | — |
| | b | — | — | — | — | — | — | — | — | — |
| | c | — | — | — | — | — | — | — | — | — |
| | d | — | — | — | — | — | — | — | — | — |

The underlined values are out of the range of the present invention.
The sign "—" denotes that the value related to the sign is equal to or lower than the level of impurities.

TABLE 2-1

| Test signs | Finish rolling temperature [° C.] | Total rolling reduction at 920° C. or lower [%] | Coiling temperature [° C.] | Cold rolling reduction [%] | Annealing heating speed [° C./s] | Annealing temperature [° C.] | Cooling rate at 700° C. or lower after annealing [° C./s] | Ac1 [° C.] | Ac3 [° C.] | Remarks |
|---|---|---|---|---|---|---|---|---|---|---|
| A1 | 870 | 43 | 550 | 67 | — | — | — | 716 | 830 | Steel of the present invention |
| B1 | 905 | 26 | 540 | 56 | — | — | — | 739 | 848 | Steel of the present invention |
| C1 | 905 | 38 | 570 | 62 | — | — | — | 689 | 801 | Steel of the present invention |
| D1 | 900 | 35 | 520 | 60 | — | — | — | 726 | 869 | Steel of the present invention |
| D2 | 880 | 34 | 580 | 48 | — | — | — | 726 | 869 | Comparative steel |
| D3 | 890 | 30 | 500 | 60 | — | — | — | 726 | 869 | Comparative steel |
| D4 | 890 | 34 | 590 | 60 | — | — | — | 726 | 869 | Comparative steel |
| D5 | 900 | 35 | 600 | 60 | — | — | — | 726 | 869 | Comparative steel |
| D6 | 910 | 30 | 600 | 60 | — | — | — | 726 | 869 | Comparative steel |
| D7 | 890 | 52 | 560 | 60 | — | — | — | 726 | 869 | Comparative steel |
| D8 | 900 | 36 | 540 | 60 | — | — | — | 726 | 869 | Comparative steel |
| D9 | 910 | 33 | 530 | 68 | 12 | 750 | 20 | 726 | 869 | Steel of the present invention |
| D10 | 910 | 29 | 600 | 68 | 12 | 750 | 20 | 726 | 869 | Comparative steel |
| D11 | 900 | 28 | 580 | 68 | 12 | 750 | 20 | 726 | 869 | Comparative steel |
| D12 | 890 | 32 | 540 | 68 | 12 | 750 | 20 | 726 | 869 | Comparative steel |
| D13 | 900 | 28 | 600 | 68 | 12 | 750 | 20 | 726 | 869 | Comparative steel |
| D14 | 900 | 37 | 560 | 68 | 12 | 750 | 20 | 726 | 869 | Comparative steel |
| D15 | 900 | 16 | 590 | 68 | 12 | 770 | 20 | 726 | 869 | Comparative steel |

TABLE 2-1-continued

| Test signs | Finish rolling temperature [° C.] | Total rolling reduction at 920° C. or lower [%] | Coiling temperature [° C.] | Cold rolling reduction [%] | Annealing heating speed [° C./s] | Annealing temperature [° C.] | Cooling rate at 700° C. or lower after annealing [° C./s] | Ac1 [° C.] | Ac3 [° C.] | Remarks |
|---|---|---|---|---|---|---|---|---|---|---|
| D16 | 880 | 35 | 520 | 68 | 12 | 700 | 20 | 726 | 869 | Comparative steel |
| D17 | 900 | 37 | 590 | 68 | 12 | 770 | 7 | 726 | 869 | Comparative steel |
| D18 | 880 | 34 | 600 | 68 | 12 | 770 | 20 | 726 | 869 | Comparative steel |
| E1 | 900 | 27 | 540 | 62 | — | — | — | 717 | 816 | Steel of the present invention |
| E2 | 890 | 38 | 540 | 45 | — | — | — | 717 | 816 | Comparative steel |
| E3 | 890 | 32 | 600 | 62 | — | — | — | 717 | 816 | Comparative steel |
| E4 | 900 | 32 | 600 | 62 | — | — | — | 717 | 816 | Comparative steel |
| E5 | 890 | 37 | 500 | 62 | — | — | — | 717 | 816 | Comparative steel |
| E6 | 900 | 33 | 540 | 62 | 10 | 760 | 30 | 717 | 816 | Steel of the present invention |
| E7 | 900 | 33 | 540 | 62 | 10 | 760 | 30 | 717 | 816 | Steel of the present invention |
| E8 | 910 | 37 | 480 | 62 | 10 | 760 | 30 | 717 | 816 | Comparative steel |
| E9 | 880 | 37 | 500 | 62 | 10 | 760 | 30 | 717 | 816 | Comparative steel |
| E10 | 850 | 45 | 620 | 62 | 5 | 760 | 30 | 717 | 816 | Comparative steel |
| E11 | 900 | 25 | 470 | 62 | 10 | 840 | 30 | 717 | 816 | Comparative steel |
| E12 | 902 | 30 | 670 | 60 | 10 | 760 | 30 | 717 | 816 | Comparative steel |

The sign "—" is applied to the annealing condition for the kind of a steel which has not been subjected to annealing.

TABLE 2-2

| Test signs | Finish rolling temperature [° C.] | Total rolling reduction at 920° C. or lower [%] | Coiling temperature [° C.] | Cold rolling reduction [%] | Annealing heating speed [° C./s] | Annealing temperature [° C.] | Cooling rate at 700° C. or lower after annealing [° C./s] | Ac1 [° C.] | Ac3 [° C.] | Remarks |
|---|---|---|---|---|---|---|---|---|---|---|
| F1 | 900 | 35 | 540 | 56 | — | — | — | 710 | 839 | Steel of the present invention |
| F2 | 890 | 31 | 560 | 56 | 15 | 760 | 30 | 710 | 839 | Steel of the present invention |
| G1 | 870 | 38 | 550 | 55 | — | — | — | 713 | 827 | Steel of the present invention |
| G2 | 900 | 30 | 560 | 55 | 15 | 760 | 20 | 713 | 827 | Steel of the present invention |
| H1 | 870 | 38 | 530 | 59 | — | — | — | 703 | 844 | Steel of the present invention |
| H2 | 900 | 26 | 530 | 59 | — | — | — | 703 | 844 | Comparative steel |
| H3 | 900 | 32 | 580 | 59 | — | — | — | 703 | 844 | Comparative steel |
| H4 | 890 | 30 | 460 | 59 | — | — | — | 703 | 844 | Comparative steel |
| H5 | 880 | 35 | 600 | 59 | — | — | — | 703 | 844 | Comparative steel |
| H6 | 880 | 40 | 500 | 59 | — | — | — | 703 | 844 | Comparative steel |
| H7 | 860 | 28 | 590 | 59 | — | — | — | 703 | 844 | Comparative steel |
| H8 | 880 | 29 | 540 | 59 | 10 | 740 | 30 | 703 | 844 | Comparative steel |
| H9 | 910 | 29 | 520 | 59 | 10 | 740 | 30 | 703 | 844 | Comparative steel |
| I1 | 890 | 33 | 540 | 72 | 10 | 750 | 30 | 729 | 812 | Steel of the present invention |
| I1 | 900 | 30 | 540 | 72 | 10 | 750 | 30 | 729 | 812 | Steel of the present invention |
| J1 | 900 | 39 | 530 | 65 | 10 | 750 | 30 | 720 | 800 | Steel of the present invention |
| K1 | 890 | 41 | 550 | 65 | — | — | — | 754 | 892 | Steel of the present invention |
| K2 | 900 | 33 | 550 | 45 | — | — | — | 754 | 892 | Comparative steel |
| K3 | 900 | 26 | 550 | 65 | — | — | — | 754 | 892 | Comparative steel |
| K4 | 890 | 35 | 600 | 65 | — | — | — | 754 | 892 | Comparative steel |
| K5 | 900 | 40 | 520 | 65 | — | — | — | 754 | 892 | Comparative steel |
| K6 | 910 | 31 | 580 | 65 | — | — | — | 754 | 892 | Comparative steel |
| K7 | 870 | 42 | 600 | 65 | — | — | — | 754 | 892 | Comparative steel |
| K8 | 860 | 42 | 550 | 65 | 10 | 780 | 20 | 754 | 892 | Steel of the present invention |
| K9 | 900 | 28 | 590 | 65 | 10 | 780 | 20 | 754 | 892 | Comparative steel |
| K10 | 870 | 35 | 520 | 65 | 10 | 780 | 20 | 754 | 892 | Comparative steel |
| K11 | 860 | 40 | 580 | 65 | 10 | 780 | 20 | 754 | 892 | Comparative steel |
| K12 | 880 | 32 | 600 | 65 | 10 | 780 | 20 | 754 | 892 | Comparative steel |
| K13 | 890 | 35 | 570 | 65 | 10 | 780 | 20 | 754 | 892 | Comparative steel |

TABLE 2-2-continued

| Test signs | Finish rolling temperature [° C.] | Total rolling reduction at 920° C. or lower [%] | Coiling temperature [° C.] | Cold rolling reduction [%] | Annealing heating speed [° C./s] | Annealing temperature [° C.] | Cooling rate at 700° C. or lower after annealing [° C./s] | Ac1 [° C.] | Ac3 [° C.] | Remarks |
|---|---|---|---|---|---|---|---|---|---|---|
| K14 | 900 | 39 | 550 | 65 | 2 | 780 | 20 | 754 | 892 | Comparative steel |
| K15 | 900 | 31 | 550 | 65 | 10 | 780 | 20 | 754 | 892 | Comparative steel |

The "—" sign is applied to the annealing condition for the kind of a steel which has not been subjected to annealing.

TABLE 2-3

| Test signs | Finish rolling temperature [° C.] | Total rolling reduction at 920° C. or lower [%] | Coiling temperature [° C.] | Cold rolling reduction [%] | Annealing heating speed [° C./s] | Annealing temperature [° C.] | Cooling rate at 700° C. or lower after annealing [C/s] | Ac1 [° C.] | Ac3 [° C.] | Remarks |
|---|---|---|---|---|---|---|---|---|---|---|
| L1 | 870 | 38 | 540 | 58 | — | — | — | 734 | 857 | Steel of the present invention |
| L2 | 900 | 34 | 540 | 58 | — | — | — | 734 | 857 | Comparative steel |
| L3 | 900 | 35 | 540 | 58 | — | — | — | 734 | 857 | Comparative steel |
| L4 | 880 | 40 | 590 | 58 | — | — | — | 734 | 857 | Comparative steel |
| L5 | 890 | 29 | 560 | 58 | — | — | — | 734 | 857 | Comparative steel |
| L6 | 910 | 28 | 560 | 58 | — | — | — | 734 | 857 | Comparative steel |
| L7 | 880 | 35 | 600 | 58 | — | — | — | 734 | 857 | Comparative steel |
| L8 | 880 | 36 | 530 | 58 | 10 | 770 | 15 | 734 | 857 | Steel of the present invention |
| L9 | 950 | 0 | 540 | 58 | 10 | 770 | 15 | 734 | 857 | Comparative steel |
| L10 | 900 | 28 | 560 | 58 | 10 | 770 | 15 | 734 | 857 | Comparative steel |
| L11 | 890 | 31 | 580 | 58 | 10 | 770 | 15 | 734 | 857 | Comparative steel |
| L12 | 870 | 32 | 600 | 58 | 10 | 770 | 15 | 734 | 857 | Comparative steel |
| L13 | 860 | 35 | 560 | 58 | 10 | 770 | 15 | 734 | 857 | Comparative steel |
| L14 | 890 | 35 | 490 | 58 | 2 | 770 | 15 | 734 | 857 | Comparative steel |
| L15 | 890 | 36 | 570 | 58 | 10 | 720 | 15 | 734 | 857 | Comparative steel |
| L16 | 870 | 38 | 590 | 58 | 10 | 770 | 8 | 734 | 857 | Comparative steel |
| M1 | 880 | 38 | 560 | 65 | — | — | — | 727 | 862 | Steel of the present invention |
| N1 | 890 | 40 | 550 | 52 | 12 | 780 | 30 | 728 | 839 | Steel of the present invention |
| O1 | 900 | 29 | 550 | 52 | — | — | — | 724 | 823 | Steel of the present invention |
| P1 | 880 | 42 | 540 | 65 | — | — | — | 728 | 852 | Steel of the present invention |
| P2 | 890 | 33 | 530 | 65 | 12 | 780 | 30 | 728 | 852 | Steel of the present invention |
| P3 | 890 | 33 | 530 | 65 | 12 | 780 | 30 | 728 | 852 | Steel of the present invention |
| Q1 | 900 | 31 | 500 | 67 | — | — | — | 695 | 843 | Steel of the present invention |
| R1 | 890 | 40 | 490 | 68 | — | — | — | 724 | 868 | Steel of the present invention |
| a1 | 900 | 31 | 600 | 82 | — | — | — | 711 | 844 | Comparative steel |
| b1 | 900 | 33 | 600 | 85 | — | — | — | 859 | 1139 | Comparative steel |
| c1 | 900 | 34 | 550 | 65 | — | — | — | 706 | 807 | Comparative steel |
| d1 | 910 | 25 | 600 | 56 | — | — | — | 660 | 786 | Comparative steel |

The sign "—" is applied to the annealing condition for the kind of a steel which has not been subjected to annealing.

TABLE 3-1

| Test signs | Heating speed of hot pressing [° C./s] | Annealing temperature of hot pressing [° C.] | Retention time during annealing of hot pressing [s] | Cooling stop temperature [° C.] | Retention temperature at 300° C. to 500° C. [° C.] | Retention time at 300° C. to 500° C. [s] | Ms [° C.] | Remarks |
|---|---|---|---|---|---|---|---|---|
| A1 | 15 | 830 | 90 | 270 | 400 | 500 | 371 | Steel of the present invention |
| B1 | 12 | 850 | 55 | 180 | 350 | 500 | 319 | Steel of the present invention |

TABLE 3-1-continued

| Test signs | Heating speed of hot pressing [° C./s] | Annealing temperature of hot pressing [° C.] | Retention time during annealing of hot pressing [s] | Cooling stop temperature [° C.] | Retention temperature at 300° C. to 500° C. [° C.] | Retention time at 300° C. to 500° C. [s] | Ms [° C.] | Remarks |
|---|---|---|---|---|---|---|---|---|
| C1 | 11 | 830 | 65 | 190 | 300 | 480 | 263 | Steel of the present invention |
| D1 | 15 | 900 | 85 | 250 | 380 | 30 | 395 | Steel of the present invention |
| D2 | 15 | 900 | 95 | 240 | 380 | 320 | 395 | Comparative steel |
| D3 | 7 | 900 | 85 | 250 | 380 | 320 | 395 | Comparative steel |
| D4 | 15 | 780 | 34 | 270 | 450 | 500 | 395 | Comparative steel |
| D5 | 15 | 900 | 4 | 300 | 370 | 430 | 395 | Comparative steel |
| D6 | 15 | 900 | 90 | 120 | 480 | 320 | 395 | Comparative steel |
| D7 | 15 | 900 | 80 | 290 | 530 | 340 | 395 | Comparative steel |
| D8 | 15 | 900 | 100 | 300 | 410 | 2400 | 395 | Comparative steel |
| D9 | 15 | 900 | 85 | 340 | 370 | 60 | 395 | Steel of the present invention |
| D10 | 15 | 800 | 90 | 300 | 400 | 30 | 395 | Comparative steel |
| D11 | 15 | 900 | 4 | 340 | 400 | 45 | 395 | Comparative steel |
| D12 | 15 | 900 | 90 | 400 | 320 | 600 | 395 | Comparative steel |
| D13 | 15 | 900 | 120 | 330 | 90 | 30 | 395 | Comparative steel |
| D14 | 15 | 900 | 80 | 270 | 380 | 2200 | 395 | Comparative steel |
| D15 | 15 | 900 | 90 | 320 | 380 | 50 | 395 | Comparative steel |
| D16 | 15 | 900 | 90 | 220 | 340 | 230 | 395 | Comparative steel |
| D17 | 15 | 900 | 95 | 300 | 370 | 400 | 395 | Comparative steel |
| D18 | 8 | 900 | 110 | 210 | 410 | 50 | 395 | Comparative steel |
| E1 | 15 | 850 | 80 | 280 | 400 | 500 | 335 | Steel of the present invention |
| E2 | 15 | 860 | 95 | 270 | 380 | 320 | 335 | Comparative steel |
| E3 | 15 | 720 | 34 | 270 | 450 | 500 | 335 | Comparative steel |
| E4 | 15 | 850 | 4 | 300 | 370 | 430 | 335 | Comparative steel |
| E5 | 15 | 850 | 85 | 40 | 370 | 60 | 335 | Comparative steel |
| E6 | 13 | 850 | 120 | 240 | 380 | 30 | 335 | Steel of the present invention |
| E7 | 13 | 840 | 120 | 250 | 360 | 60 | 335 | Steel of the present invention |
| E8 | 13 | 720 | 110 | 280 | 410 | 50 | 335 | Comparative steel |
| E9 | 13 | 850 | 4 | 300 | 380 | 40 | 335 | Comparative steel |
| E10 | 13 | 850 | 95 | 240 | 370 | 60 | 335 | Comparative steel |
| E11 | 13 | 850 | 80 | 280 | 300 | 20 | 335 | Comparative steel |
| E12 | 13 | 860 | 120 | 240 | 380 | 30 | 335 | Comparative steel |

The sign "—" is applied to the alloying treatment condition for the kind of a steel which has not been subjected to alloying treatment.

TABLE 3-2

| Test signs | Heating speed of hot pressing [° C./s] | Annealing temperature of hot pressing [° C.] | Retention time during annealing of hot pressing [s] | Cooling stop temperature [° C.] | Retention temperature at 300° C. to 500° C. [° C.] | Retention time at 300° C. to 500° C. [s] | Ms [° C.] | Remarks |
|---|---|---|---|---|---|---|---|---|
| F1 | 15 | 880 | 120 | 270 | 300 | 330 | 326 | Steel of the present invention |
| F2 | 15 | 880 | 100 | 190 | 350 | 380 | 326 | Steel of the present invention |
| G1 | 15 | 840 | 130 | 100 | 330 | 340 | 283 | Steel of the present invention |
| G2 | 15 | 830 | 120 | 240 | 360 | 350 | 283 | Steel of the present invention |
| H1 | 15 | 890 | 120 | 210 | 300 | 550 | 360 | Steel of the present invention |
| H2 | 8 | 890 | 130 | 200 | 400 | 60 | 360 | Comparative steel |
| H3 | 15 | 800 | 220 | 160 | 400 | 250 | 360 | Comparative steel |
| H4 | 15 | 890 | 5 | 170 | 320 | 300 | 360 | Comparative steel |
| H5 | 15 | 880 | 150 | 100 | 490 | 360 | 360 | Comparative steel |
| H6 | 15 | 880 | 110 | 270 | 530 | 300 | 360 | Comparative steel |
| H7 | 12 | 880 | 120 | 300 | 410 | 2200 | 360 | Comparative steel |
| H8 | 12 | 800 | 130 | 280 | 360 | 330 | 360 | Comparative steel |
| H9 | 12 | 880 | 130 | 370 | 400 | 45 | 360 | Comparative steel |
| I1 | 15 | 850 | 130 | 180 | 400 | 400 | 299 | Steel of the present invention |
| I1 | 15 | 850 | 130 | 275 | 450 | 400 | 299 | Steel of the present invention |
| J1 | 15 | 840 | 120 | 260 | 400 | 330 | 296 | Steel of the present invention |

TABLE 3-2-continued

| Test signs | Heating speed of hot pressing [° C./s] | Annealing temperature of hot pressing [° C.] | Retention time during annealing of hot pressing [s] | Cooling stop temperature [° C.] | Retention temperature at 300° C. to 500° C. [° C.] | Retention time at 300° C. to 500° C. [s] | Ms [° C.] | Remarks |
|---|---|---|---|---|---|---|---|---|
| K1 | 15 | 900 | 120 | 240 | 350 | 380 | 389 | Steel of the present invention |
| K2 | 15 | 900 | 130 | 300 | 340 | 425 | 392 | Comparative steel |
| K3 | 2 | 900 | 130 | 300 | 340 | 425 | 392 | Comparative steel |
| K4 | 15 | 750 | 120 | 250 | 350 | 400 | 392 | Comparative steel |
| K5 | 15 | 900 | 5 | 350 | 330 | 420 | 392 | Comparative steel |
| K6 | 15 | 900 | 150 | 400 | 470 | 400 | 392 | Comparative steel |
| K7 | 15 | 900 | 130 | 200 | 80 | 330 | 392 | Comparative steel |
| K8 | 15 | 920 | 130 | 300 | 340 | 425 | 389 | Steel of the present invention |
| K9 | 15 | 750 | 120 | 250 | 350 | 400 | 392 | Comparative steel |
| K10 | 15 | 900 | 5 | 350 | 330 | 420 | 392 | Comparative steel |
| K11 | 15 | 900 | 150 | 400 | 470 | 400 | 392 | Comparative steel |
| K12 | 15 | 900 | 130 | 200 | 80 | 330 | 392 | Comparative steel |
| K13 | 15 | 900 | 140 | 260 | 360 | 1800 | 392 | Comparative steel |
| K14 | 15 | 910 | 130 | 300 | 340 | 425 | 392 | Comparative steel |
| K15 | 2 | 910 | 130 | 300 | 340 | 425 | 392 | Comparative steel |

The sign "—" is applied to the alloying treatment condition for the kind of a steel which has not been subjected to alloying treatment.

TABLE 3-3

| Test signs | Heating speed of hot pressing [° C./s] | Annealing temperature of hot pressing [° C.] | Retention time during annealing of hot pressing [s] | Cooling stop temperature [° C.] | Retention temperature at 300° C. to 500° C. [° C.] | Retention time at 300° C. to 500° C. [s] | Ms [° C.] | Remarks |
|---|---|---|---|---|---|---|---|---|
| L1 | 15 | 890 | 90 | 230 | 340 | 420 | 392 | Steel of the present invention |
| L2 | 2 | 890 | 140 | 270 | 390 | 350 | 392 | Comparative steel |
| L3 | 15 | 740 | 130 | 320 | 380 | 300 | 392 | Comparative steel |
| L4 | 15 | 880 | 5 | 310 | 400 | 400 | 392 | Comparative steel |
| L5 | 15 | 890 | 120 | 140 | 480 | 400 | 392 | Comparative steel |
| L6 | 15 | 890 | 160 | 160 | 80 | 600 | 392 | Comparative steel |
| L7 | 15 | 890 | 130 | 310 | 410 | 1800 | 392 | Comparative steel |
| L8 | 12 | 900 | 120 | 290 | 350 | 30 | 392 | Steel of the present invention |
| L9 | 12 | 900 | 120 | 240 | 350 | 45 | 392 | Comparative steel |
| L10 | 12 | 900 | 5 | 260 | 350 | 35 | 392 | Comparative steel |
| L11 | 12 | 900 | 150 | 140 | 470 | 400 | 392 | Comparative steel |
| L12 | 12 | 900 | 130 | 260 | 80 | 330 | 392 | Comparative steel |
| L13 | 12 | 890 | 120 | 300 | 550 | 1800 | 392 | Comparative steel |
| L14 | 12 | 890 | 120 | 310 | 350 | 30 | 392 | Comparative steel |
| L15 | 12 | 880 | 120 | 310 | 330 | 30 | 392 | Comparative steel |
| L16 | 12 | 900 | 120 | 300 | 350 | 330 | 392 | Comparative steel |
| M1 | 15 | 870 | 120 | 320 | 360 | 480 | 402 | Steel of the present invention |
| N1 | 15 | 870 | 150 | 260 | 330 | 450 | 359 | Steel of the present invention |
| O1 | 15 | 850 | 130 | 280 | 340 | 500 | 338 | Steel of the present invention |
| P1 | 15 | 870 | 110 | 300 | 330 | 430 | 376 | Steel of the present invention |
| P2 | 15 | 870 | 90 | 340 | 340 | 390 | 376 | Steel of the present invention |
| P3 | 15 | 860 | 90 | 355 | 365 | 390 | 376 | Steel of the present invention |
| Q1 | 15 | 850 | 120 | 220 | 350 | 420 | 299 | Steel of the present invention |
| R1 | 15 | 900 | 140 | 350 | 330 | 400 | 452 | Steel of the present invention |
| a1 | 15 | 890 | 50 | 370 | 390 | 420 | 441 | Comparative steel |
| b1 | 15 | 950 | 30 | 100 | 380 | 350 | 163 | Comparative steel |
| c1 | 15 | 850 | 60 | 270 | 360 | 460 | 362 | Comparative steel |
| d1 | 15 | 830 | 30 | 100 | 400 | 400 | 163 | Comparative steel |

The sign "—" is applied to the alloying treatment condition for the kind of a steel which has not been subjected to alloying treatment.

Subsequently, identification of the microstructures of each of the steel sheets A1 to d1 and analysis of the textures were performed by the method described above. Subsequently, mechanical properties of each of the steel sheets A1 to d1 were examined by the following method.

Tensile strength TS (MPa) and fracture elongation E1(%) were measured through a tensile test. The tension test pieces conformed to the JIS No. 5 test piece, which were each collected from a location in the transvers direction of a plate having the thickness of 1.2 mm. A sample having tensile strength of 1,200 MPa or higher was determined as a sample having favorable tensile strength.

The r value for the rolling direction and the r value for the transvers direction, and the limitation of bending (R/t) in the rolling direction and the limitation of bending (R/t) in the transvers direction were measured through a bending test. The specific measuring method was as follows.

The r value was obtained by collecting a test piece conforming to JIS Z 2201 and performing a test conforming to the definition in JIS Z 2254. The r value for the rolling direction was measured using the test piece of which the rolling direction was the longitudinal direction, and the r value for the transvers direction was measured using the test piece of which the transvers direction was the longitudinal direction.

Then limitation of bending Pit was obtained by performing a test conforming to the V-block method defined in JIS Z 2248 with respect to the No. 1 test piece defined in JIS Z 2204. The limitation of bending in the rolling direction was measured using the test piece collected such that a bending ridge line lies along the rolling direction, and the limitation of bending in the transvers direction was measured using the test piece collected such that the bending ridge line lies along the transvers direction. In the test, bending was repeated using a plurality of pressing metal fittings having radii R of curvature different from each other. After the bending test, cracking in a bent portion was determined using an optical microscope or an SEM, and the limitation of bending R/t (R: the bend radius of the test piece (that is, the radius of curvature of the pressing metal fitting), and t: the sheet thickness of the test piece) at which no cracking occurred was calculated and evaluated.

Tables 4-1 to 5-3 show the results of the identification and the like of the structures, and the performance of each thereof. The underlined numerical values in Tables 4-1 to 4-3 are numerical values out of the range of the present invention. In addition, in Tables 4-1 to 5-3, tM (%) denotes the volume fraction of tempered martensite in the microstructure, B (%) denotes the volume fraction of bainite in the microstructure, γR (%) denotes the volume fraction of residual austenite in the microstructure, F (%) denotes the volume fraction of ferrite in the microstructure, TS (MPa) denotes the tensile strength, E1(%) denotes the fracture elongation, and TSxEl denotes the tensile product, respectively.

TABLE 4-1

| Test signs | tM [%] | B [%] | γR [%] | F [%] | {211}<011> | Remarks |
|---|---|---|---|---|---|---|
| A1 | 67 | 21 | 12 | 0 | 4.6 | Steel of the present invention |
| B1 | 78 | 14 | 8 | 0 | 3.1 | Steel of the present invention |
| C1 | 55 | 34 | 10 | 0 | 3.6 | Steel of the present invention |

TABLE 4-1-continued

| Test signs | tM [%] | B [%] | γR [%] | F [%] | {211}<011> | Remarks |
|---|---|---|---|---|---|---|
| D1 | 80 | 12 | 8 | 0 | 3.6 | Steel of the present invention |
| D2 | 82 | 10 | 8 | 0 | 2.7 | Comparative steel |
| D3 | 80 | 12 | 8 | 0 | 2.4 | Comparative steel |
| D4 | 55 | 6 | 12 | 27 | 3.4 | Comparative steel |
| D5 | 85 | 13 | 2 | 0 | 3.9 | Comparative steel |
| D6 | 95 | 3 | 2 | 0 | 3.9 | Comparative steel |
| D7 | 85 | 12 | 3 | 0 | 3.9 | Comparative steel |
| D8 | 65 | 32 | 3 | 0 | 3.9 | Comparative steel |
| D9 | 45 | 42 | 13 | 0 | 3.4 | Steel of the present invention |
| D10 | 35 | 29 | 11 | 25 | 3.2 | Comparative steel |
| D11 | 57 | 39 | 4 | 0 | 3.4 | Comparative steel |
| D12 | 5 | 78 | 17 | 0 | 3.3 | Comparative steel |
| D13 | 98 | 0 | 2 | 0 | 3.6 | Comparative steel |
| D14 | 75 | 22 | 3 | 0 | 3.0 | Comparative steel |
| D15 | 64 | 29 | 7 | 0 | 2.0 | Comparative steel |
| D16 | 85 | 8 | 7 | 0 | 2.2 | Comparative steel |
| D17 | 65 | 25 | 10 | 0 | 2.2 | Comparative steel |
| D18 | 87 | 6 | 7 | 0 | 2.0 | Comparative steel |
| E1 | 45 | 42 | 13 | 0 | 3.7 | Steel of the present invention |
| E2 | 51 | 35 | 12 | 2 | 2.8 | Comparative steel |
| E3 | 51 | 14 | 11 | 23 | 4.1 | Comparative steel |
| E4 | 62 | 34 | 4 | 0 | 3.7 | Comparative steel |
| E5 | 91 | 2 | 6 | 1 | 3.9 | Comparative steel |
| E6 | 65 | 22 | 9 | 4 | 3.3 | Steel of the present invention |
| E7 | 61 | 23 | 8 | 8 | 3.2 | Steel of the present invention |
| E8 | 45 | 7 | 13 | 35 | 3.1 | Comparative steel |
| E9 | 72 | 24 | 4 | 0 | 3.3 | Comparative steel |
| E10 | 65 | 27 | 8 | 0 | 2.4 | Comparative steel |
| E11 | 45 | 43 | 11 | 0 | 2.2 | Comparative steel |
| E12 | 65 | 21 | 10 | 4 | 2.8 | Comparative steel |

The underlined values are out of the range of the present invention.
F: ferrite,
B: bainite,
γR: residual austenite, and
tM: tempered martensite

TABLE 4-2

| Test signs | tM [%] | B [%] | γK [%] | F [%] | {211}<011> | Remarks |
|---|---|---|---|---|---|---|
| F1 | 46 | 43 | 11 | 0 | 3.4 | Steel of the present invention |
| F2 | 78 | 14 | 8 | 0 | 3.6 | Steel of the present invention |
| G1 | 87 | 7 | 7 | 0 | 3.5 | Steel of the present invention |
| G2 | 38 | 49 | 13 | 0 | 3.5 | Steel of the present invention |
| H1 | 81 | 12 | 7 | 0 | 3.9 | Steel of the present invention |
| H2 | 83 | 10 | 8 | 0 | 2.1 | Comparative steel |
| H3 | 30 | 30 | 12 | 28 | 3.7 | Comparative steel |
| H4 | 88 | 8 | 4 | 0 | 3.8 | Comparative steel |
| H5 | 94 | 0 | 6 | 0 | 3.7 | Comparative steel |
| H6 | 74 | 23 | 3 | 0 | 3.8 | Comparative steel |
| H7 | 62 | 34 | 4 | 0 | 2.5 | Comparative steel |
| H8 | 20 | 39 | 13 | 28 | 3.2 | Comparative steel |
| H9 | 3 | 78 | 19 | 0 | 3.4 | Comparative steel |
| I1 | 73 | 20 | 7 | 0 | 3.3 | Steel of the present invention |
| I1 | 23 | 54 | 22 | 0 | 3.0 | Steel of the present invention |
| J1 | 36 | 47 | 17 | 0 | 3.3 | Steel of the present invention |
| K1 | 81 | 9 | 10 | 0 | 3.8 | Steel of the present invention |
| K2 | 64 | 28 | 8 | 0 | 2.4 | Comparative steel |
| K3 | 64 | 28 | 8 | 0 | 2.2 | Comparative steel |

TABLE 4-2-continued

| Test signs | tM [%] | B [%] | γK [%] | F [%] | {211}<011> | Remarks |
|---|---|---|---|---|---|---|
| K4 | 20 | 53 | 5 | 22 | 3.9 | Comparative steel |
| K5 | 47 | 49 | 4 | 0 | 4.1 | Comparative steel |
| K6 | 15 | 80 | 5 | 0 | 4.0 | Comparative steel |
| K7 | 93 | 4 | 3 | 0 | 4.0 | Comparative steel |
| K8 | 62 | 29 | 9 | 0 | 4.0 | Steel of the present invention |
| K9 | 20 | 50 | 8 | 22 | 4.0 | Comparative steel |
| K10 | 47 | 49 | 4 | 0 | 3.8 | Comparative steel |
| K11 | 18 | 77 | 5 | 0 | 3.6 | Comparative steel |
| K12 | 93 | 4 | 3 | 0 | 3.7 | Comparative steel |
| K13 | 77 | 19 | 4 | 0 | 3.9 | Comparative steel |
| K14 | 64 | 28 | 8 | 0 | 1.6 | Comparative steel |
| K15 | 64 | 28 | 8 | 0 | 2.2 | Comparative steel |

The underlined values are out of the range of the present invention.
F: ferrite,
B: bainite,
γR: residual austenite, and
tM: tempered martensite

TABLE 4-3

| Test signs | tM [%] | B [%] | γR [%] | F [%] | {211}<011> | Remarks |
|---|---|---|---|---|---|---|
| L1 | 83 | 8 | 9 | 0 | 3.8 | Steel of the present invention |
| L2 | 74 | 17 | 9 | 0 | 2.3 | Comparative steel |
| L3 | 30 | 37 | 13 | 20 | 3.5 | Comparative steel |
| L4 | 59 | 39 | 2 | 0 | 3.9 | Comparative steel |
| L5 | 94 | 4 | 2 | 0 | 3.6 | Comparative steel |
| L6 | 98 | 0 | 2 | 0 | 3.5 | Comparative steel |
| L7 | 59 | 38 | 3 | 0 | 3.4 | Comparative steel |

TABLE 4-3-continued

| Test signs | tM [%] | B [%] | γR [%] | F [%] | {211}<011> | Remarks |
|---|---|---|---|---|---|---|
| L8 | 67 | 25 | 8 | 0 | 3.3 | Steel of the present invention |
| L9 | 48 | 40 | 12 | 0 | 2.3 | Comparative steel |
| L10 | 88 | 8 | 4 | 0 | 3.7 | Comparative steel |
| L11 | 94 | 4 | 2 | 0 | 3.7 | Comparative steel |
| L12 | 93 | 4 | 3 | 0 | 3.4 | Comparative steel |
| L13 | 64 | 32 | 4 | 0 | 3.5 | Comparative steel |
| L14 | 59 | 31 | 10 | 0 | 2.2 | Comparative steel |
| L15 | 59 | 31 | 9 | 0 | 2.4 | Comparative steel |
| L16 | 64 | 28 | 9 | 0 | 2.4 | Comparative steel |
| M1 | 59 | 31 | 10 | 0 | 3.8 | Steel of the present invention |
| N1 | 66 | 28 | 6 | 0 | 3.3 | Steel of the present invention |
| O1 | 47 | 43 | 9 | 0 | 3.4 | Steel of the present invention |
| P1 | 57 | 38 | 5 | 0 | 4.0 | Steel of the present invention |
| P2 | 33 | 59 | 9 | 0 | 3.4 | Steel of the present invention |
| P2 | 21 | 69 | 8 | 2 | 3.4 | Steel of the present invention |
| Q1 | 58 | 32 | 10 | 0 | 3.9 | Steel of the present invention |
| R1 | 68 | 25 | 7 | 0 | 4.0 | Steel of the present invention |
| a1 | 54 | 34 | 12 | 0 | 4.6 | Comparative steel |
| b1 | 94 | 0 | 6 | 0 | 4.9 | Comparative steel |
| c1 | 81 | 16 | 3 | 0 | 3.9 | Comparative steel |
| d1 | 50 | 39 | 11 | 0 | 3.6 | Comparative steel |

The underlined values are out of the range of the present invention.
F: ferrite,
B: bainite,
γR: residual austenite, and
tM: tempered martensite

TABLE 5-1

| Test signs | TS [MPa] | El [%] | TS × EL [MPa · %] | r value for rolling direction | r value for transvers direction | Limitation of bending in rolling direction | Limitation of bending in transvers direction | Remarks |
|---|---|---|---|---|---|---|---|---|
| A1 | 1388 | 25 | 34428 | 0.69 | 0.73 | 1.5 | 1.6 | Steel of the present invention |
| B1 | 1426 | 19 | 26793 | 0.78 | 0.77 | 1.8 | 1.8 | Steel of the present invention |
| C1 | 1362 | 22 | 30639 | 0.71 | 0.75 | 1.6 | 1.6 | Steel of the present invention |
| D1 | 1430 | 19 | 26866 | 0.72 | 0.76 | 1.6 | 1.7 | Steel of the present invention |
| D2 | 1435 | 19 | 27257 | 0.81 | 0.81 | 2.1 | 2.1 | Comparative steel |
| D3 | 1429 | 19 | 27156 | 0.85 | 0.86 | 2.2 | 2.2 | Comparative steel |
| D4 | 949 | 25 | 23733 | 0.72 | 0.76 | 0.3 | 0.4 | Comparative steel |
| D5 | 1458 | 10 | 14575 | 0.72 | 0.76 | 1.8 | 1.9 | Comparative steel |
| D6 | 1483 | 10 | 14829 | 0.72 | 0.76 | 2.5 | 2.5 | Comparative steel |
| D7 | 1240 | 12 | 14260 | 0.72 | 0.76 | 0.8 | 0.9 | Comparative steel |
| D8 | 1340 | 13 | 17420 | 0.72 | 0.76 | 1.5 | 1.7 | Comparative steel |
| D9 | 1332 | 26 | 34357 | 0.79 | 0.79 | 1.2 | 1.4 | Steel of the present invention |
| D10 | 935 | 27 | 25251 | 0.79 | 0.79 | 0.3 | 0.3 | Comparative steel |
| D11 | 1383 | 13 | 17973 | 0.79 | 0.79 | 1.5 | 1.7 | Comparative steel |
| D12 | 1145 | 32 | 36800 | 0.79 | 0.79 | 0.5 | 0.5 | Comparative steel |
| D13 | 1520 | 10 | 15200 | 0.79 | 0.79 | 2.7 | 2.7 | Comparative steel |
| D14 | 1360 | 12 | 15640 | 0.79 | 0.79 | 1.5 | 1.5 | Comparative steel |
| D15 | 1393 | 18 | 24369 | 0.85 | 0.86 | 2.1 | 2.1 | Comparative steel |
| D16 | 1287 | 17 | 22296 | 0.87 | 0.87 | 2.2 | 2.2 | Comparative steel |
| D17 | 1387 | 22 | 30207 | 0.85 | 0.86 | 2.1 | 2.1 | Comparative steel |
| D18 | 1450 | 17 | 25332 | 0.86 | 0.87 | 2.4 | 2.5 | Comparative steel |
| E1 | 1331 | 27 | 35419 | 0.71 | 0.75 | 1.4 | 1.4 | Steel of the present invention |
| E2 | 1319 | 26 | 34187 | 0.82 | 0.82 | 2.1 | 2.1 | Comparative steel |
| E3 | 998 | 41 | 41029 | 0.71 | 0.75 | 0.4 | 0.4 | Comparative steel |
| E4 | 1395 | 13 | 18135 | 0.71 | 0.75 | 1.6 | 1.8 | Comparative steel |

TABLE 5-1-continued

| Test signs | TS [MPa] | El [%] | TS × EL [MPa · %] | r value for rolling direction | r value for transvers direction | Limitation of bending in rolling direction | Limitation of bending in transvers direction | Remarks |
|---|---|---|---|---|---|---|---|---|
| E5 | 1447 | 17 | 24464 | 0.71 | 0.75 | 2.4 | 2.5 | Comparative steel |
| E6 | 1329 | 24 | 32011 | 0.78 | 0.79 | 1.3 | 1.4 | Steel of the present invention |
| E7 | 1262 | 25 | 31546 | 0.79 | 0.79 | 1.4 | 1.5 | Steel of the present invention |
| E8 | 806 | 30 | 24179 | 0.78 | 0.79 | 0.3 | 0.3 | Comparative steel |
| E9 | 1420 | 15 | 21300 | 0.78 | 0.79 | 1.7 | 1.8 | Comparative steel |
| E10 | 1392 | 19 | 26449 | 0.82 | 0.83 | 2.1 | 2.1 | Comparative steel |
| E11 | 1335 | 24 | 32358 | 0.85 | 0.86 | 2.2 | 2.2 | Comparative steel |
| E12 | 1327 | 25 | 33177 | 0.83 | 0.82 | 2.1 | 2.2 | Comparative steel |

TABLE 5-2

| Test signs | TS [MPa] | El [%] | TS × EL [MPa · %] | r value for rolling direction | r value for transvers direction | Limitation of bending in rolling direction | Limitation of bending in transvers direction | Remarks |
|---|---|---|---|---|---|---|---|---|
| F1 | 1336 | 24 | 32256 | 0.74 | 0.77 | 1.4 | 1.5 | Steel of the present invention |
| F2 | 1424 | 19 | 26959 | 0.74 | 0.77 | 1.6 | 1.7 | Steel of the present invention |
| G1 | 1450 | 21 | 30448 | 0.75 | 0.78 | 1.7 | 1.8 | Steel of the present invention |
| G2 | 1311 | 27 | 35517 | 0.75 | 0.78 | 1.4 | 1.5 | Steel of the present invention |
| H1 | 1434 | 19 | 27242 | 0.73 | 0.76 | 1.6 | 1.7 | Steel of the present invention |
| H2 | 1438 | 18 | 26342 | 0.85 | 0.82 | 2.1 | 2.1 | Comparative steel |
| H3 | 880 | 29 | 25510 | 0.73 | 0.76 | 1.7 | 1.9 | Comparative steel |
| H4 | 1459 | 13 | 18968 | 0.73 | 0.76 | 2.2 | 2.4 | Comparative steel |
| H5 | 1470 | 16 | 23714 | 0.73 | 0.76 | 1.7 | 1.8 | Comparative steel |
| H6 | 1428 | 12 | 16416 | 0.73 | 0.76 | 1.6 | 1.7 | Comparative steel |
| H7 | 1395 | 13 | 18135 | 0.82 | 0.83 | 2.1 | 2.3 | Comparative steel |
| H8 | 852 | 30 | 25565 | 0.78 | 0.79 | 0.3 | 0.4 | Comparative steel |
| H9 | 1125 | 23 | 25875 | 0.78 | 0.79 | 0.4 | 0.4 | Comparative steel |
| I1 | 1388 | 21 | 29154 | 0.78 | 0.79 | 1.6 | 1.7 | Steel of the present invention |
| I1 | 1267 | 38 | 48162 | 0.79 | 0.79 | 1.7 | 1.8 | Steel of the present invention |
| J1 | 1304 | 33 | 43173 | 0.78 | 0.79 | 1.5 | 1.5 | Steel of the present invention |
| K1 | 1391 | 24 | 33381 | 0.70 | 0.74 | 1.6 | 1.7 | Steel of the present invention |
| K2 | 1370 | 21 | 28309 | 0.82 | 0.82 | 2.1 | 2.1 | Comparative steel |
| K3 | 1370 | 21 | 28309 | 0.83 | 0.85 | 2.1 | 2.1 | Comparative steel |
| K4 | 925 | 28 | 25895 | 0.70 | 0.74 | 0.4 | 0.4 | Comparative steel |
| K5 | 1359 | 14 | 19019 | 0.70 | 0.74 | 1.6 | 1.7 | Comparative steel |
| K6 | 1154 | 16 | 17887 | 0.70 | 0.74 | 1.7 | 1.8 | Comparative steel |
| K7 | 1431 | 13 | 17881 | 0.70 | 0.74 | 2.2 | 2.4 | Comparative steel |
| K8 | 1367 | 21 | 28834 | 0.73 | 0.75 | 1.4 | 1.5 | Steel of the present invention |
| K9 | 916 | 28 | 25643 | 0.73 | 0.75 | 0.3 | 0.4 | Comparative steel |
| K10 | 1359 | 14 | 19019 | 0.73 | 0.75 | 1.4 | 1.5 | Comparative steel |
| K11 | 1172 | 18 | 21096 | 0.73 | 0.75 | 1.6 | 1.7 | Comparative steel |
| K12 | 1284 | 15 | 19260 | 0.73 | 0.75 | 2.1 | 2.1 | Comparative steel |
| K13 | 1403 | 13 | 18238 | 0.73 | 0.75 | 1.7 | 1.8 | Comparative steel |
| K14 | 1370 | 21 | 28309 | 0.86 | 0.89 | 2.1 | 2.2 | Comparative steel |
| K15 | 1370 | 21 | 28309 | 0.83 | 0.84 | 2.1 | 2.1 | Comparative steel |

TABLE 5-3

| Test signs | TS [MPa] | El [%] | TS × EL [MPa · %] | r value for rolling direction | r value for transvers direction | Limitation of bending in rolling direction | Limitation of bending in transvers direction | Remarks |
|---|---|---|---|---|---|---|---|---|
| L1 | 1398 | 22 | 30052 | 0.73 | 0.77 | 1.7 | 1.8 | Steel of the present invention |
| L2 | 1384 | 22 | 29752 | 0.84 | 0.86 | 2.1 | 2.1 | Comparative steel |
| L3 | 949 | 27 | 25612 | 0.73 | 0.77 | 0.4 | 0.4 | Comparative steel |
| L4 | 1383 | 11 | 15215 | 0.73 | 0.77 | 1.5 | 1.6 | Comparative steel |
| L5 | 1435 | 11 | 15713 | 0.73 | 0.77 | 2.3 | 2.5 | Comparative steel |
| L6 | 1441 | 11 | 15851 | 0.73 | 0.77 | 2.2 | 2.4 | Comparative steel |
| L7 | 1284 | 13 | 16050 | 0.73 | 0.77 | 1.3 | 1.4 | Comparative steel |
| L8 | 1378 | 20 | 26952 | 0.76 | 0.78 | 1.6 | 1.7 | Steel of the present invention |
| L9 | 1336 | 30 | 40080 | 0.85 | 0.92 | 2.1 | 2.2 | Comparative steel |
| L10 | 1420 | 14 | 19880 | 0.76 | 0.78 | 1.6 | 1.7 | Comparative steel |
| L11 | 1435 | 11 | 15610 | 0.76 | 0.78 | 2.1 | 2.2 | Comparative steel |
| L12 | 1431 | 13 | 17881 | 0.76 | 0.78 | 2.1 | 2.1 | Comparative steel |
| L13 | 1383 | 12 | 16602 | 0.76 | 0.78 | 2.1 | 2.2 | Comparative steel |
| L14 | 1360 | 22 | 30475 | 0.87 | 0.87 | 2.1 | 2.2 | Comparative steel |
| L15 | 1361 | 22 | 29778 | 0.85 | 0.86 | 2.1 | 2.2 | Comparative steel |
| L16 | 1370 | 21 | 28630 | 0.83 | 0.83 | 2.1 | 2.2 | Comparative steel |
| M1 | 1359 | 23 | 31260 | 0.70 | 0.74 | 1.4 | 1.5 | Steel of the present invention |
| N1 | 1381 | 19 | 26242 | 0.76 | 0.78 | 1.4 | 1.5 | Steel of the present invention |
| O1 | 1343 | 22 | 29546 | 0.76 | 0.79 | 1.4 | 1.5 | Steel of the present invention |
| P1 | 1369 | 27 | 36951 | 0.70 | 0.74 | 1.3 | 1.5 | Steel of the present invention |
| P2 | 1323 | 21 | 27819 | 0.76 | 0.78 | 1.3 | 1.4 | Steel of the present invention |
| P2 | 1271 | 21 | 26690 | 0.76 | 0.78 | 1.3 | 1.4 | Steel of the present invention |
| Q1 | 1357 | 23 | 31045 | 0.69 | 0.73 | 1.3 | 1.4 | Steel of the present invention |
| R1 | 1379 | 19 | 26342 | 0.69 | 0.73 | 1.3 | 1.4 | Steel of the present invention |
| a1 | 786 | 32 | 25152 | 0.63 | 0.68 | 0.3 | 0.3 | Comparative steel |
| b1 | 1723 | 11 | 18953 | 0.61 | 0.66 | 2.5 | 2.6 | Comparative steel |
| c1 | 1413 | 12 | 17043 | 0.70 | 0.74 | 1.7 | 1.8 | Comparative steel |
| d1 | 998 | 19 | 18962 | 0.74 | 0.77 | 1.4 | 1.5 | Comparative steel |

As shown in Tables 5-1 to 5-3, particularly in each of the examples of the invention in which the composition, the structure, and the texture of the steel were ameliorated, it is ascertained that the tensile strength is 1,200 MPa or higher, the tensile product is 26,000 (MPa·%) or higher, both the r value for the rolling direction and the r value for the transvers direction are 0.80 or smaller, and both the limitation of bending in the rolling direction and the limitation of bending in the transvers direction are 2.0 or smaller. Therefore, it is possible to mention that all of the examples of the invention have high strength and excellent ductility and bendability.

In contrast, as shown in Tables 5-1 to 5-3, in each of the examples in the related art in which the composition, the structure, and the texture of the steel are not ameliorated to the range of the present invention, at least any of the tensile product, the r value for the rolling direction, the r value for the transvers direction, the limitation of bending in the rolling direction, and the limitation of bending in the transvers direction is not in the preferable range.

INDUSTRIAL APPLICABILITY

According to the present invention, in a high strength hot press-formed part, both ductility and bendability are exhibited at a high level. Therefore, the present invention is particularly useful in the field of structure parts for automobiles.

The invention claimed is:

1. A hot press-formed part comprising, by unit mass %,

C: 0.100% to 0.600%,

Si: 1.00% to 3.00%,

Mn: 1.00% to 5.00%,

P: 0.040% or less,

S: 0.0500% or less,

Al: 0.001% to 2.000%,

N: 0.0100% or less,

O: 0.0100% or less,

Mo: 0% to 1.00%,

Cr: 0% to 2.00%,

Ni: 0% to 2.00%,

Cu: 0% to 2.00%,

Nb: 0% to 0.300%,

Ti: 0% to 0.300%,

V: 0% to 0.300%,

B: 0% to 0.1000%,

Ca: 0% to 0.0100%,

Mg: 0% to 0.0100%,

REM: 0% to 0.0100%, and a remainder including Fe and impurities, wherein a microstructure in a thickness ¼ portion includes, by unit vol %, tempered martensite: 20% to 90%, bainite: 5% to 75%, and residual austenite: 5% to 25%, and ferrite is limited to 10% or less, wherein a pole density of an orientation {211}<011> in the thickness ¼ portion is 3.0 or higher, and a tensile strength TS is 1.200 MPa or higher, a tensile product TSxEl is 26.000 MPa % or higher, both an r value for a rolling direction and an r value for a transvers direction is 0.80 or smaller, and both limitation of bending (R/t) in the rolling direction and limitation of bending (R/t) in the transvers direction is 2,0 or smaller.

2. The hot press-formed part according to claim 1 comprising, by unit mass %, at least one selected from the group consisting of Mo: 0.01% to 1.00%, Cr: 0.05% to 2.00%, Ni: 0.05% to 2.00%, and Cu: 0.05% to 2.00%.

3. The hot press-formed part according to claim 1 comprising, by unit mass %, at least one selected from the group consisting of Nb: 0.005% to 0.300%, Ti: 0.005% to 0.300%, and V: 0.005% to 0.300%.

4. The hot press-formed part according to claim 1 comprising, by unit mass %, B: 0.0001% to 0.1000%.

5. The hot press-formed part according to claim 1 comprising, by unit mass %, at least one selected from the group consisting of Ca: 0.0005% to 0.0100%, Mg: 0.0005% to 0.0100%, and REM: 0.0005% to 0.0100%.

6. The hot press-formed part according to claim 2 comprising, by unit mass %, at least one selected from the group consisting of Nb: 0.005% to 0.300%, Ti: 0.005% to 0.300%, and V: 0.005% to 0.300%.

7. The hot press-formed part according to claim 2 comprising, by unit mass %, B: 0.0001% to 0.1000%.

8. The hot press-formed part according to claim 3 comprising, by unit mass %, B: 0.0001% to 0.1000%.

9. The hot press-formed part according to claim 6 comprising, by unit mass %, B: 0.0001% to 0.1000%.

10. The hot press-formed part according to claim 2 comprising, by unit mass %, at least one selected from the group consisting of Ca: 0.0005% to 0.0100%, Mg: 0.0005% to 0.0100%, and REM: 0.0005% to 0.0100%.

11. The hot press-formed part according to claim 3 comprising, by unit mass %, at least one selected from the group consisting of Ca: 0.0005% to 0.0100%, Mg: 0.0005% to 0.0100%, and REM: 0.0005% to 0.0100%.

12. The hot press-formed part according to claim 4 comprising, by unit mass %, at least one selected from the group consisting of Ca: 0.0005% to 0.0100%, Mg: 0.0005% to 0.0100%, and REM: 0.0005% to 0.0100%.

13. The hot press-formed part according to claim 6 comprising, by unit mass %, at least one selected from the group consisting of Ca: 0.0005% to 0.0100%, Mg: 0.0005% to 0.0100%, and REM: 0.0005% to 0.0100%.

14. The hot press-formed part according to claim 7 comprising, by unit mass %, at least one selected from the group consisting of Ca: 0.0005% to 0.0100%, Mg: 0.0005% to 0.0100%, and REM: 0.0005% to 0.0100%.

15. The hot press-formed part according to claim 8 comprising, by unit mass %, at least one selected from the group consisting of Ca: 0.0005% to 0.0100%, Mg: 0.0005% to 0.0100%, and REM: 0.0005% to 0.0100%.

16. The hot press-formed part according to claim 9 comprising, by unit mass %, at least one selected from the group consisting of Ca: 0.0005% to 0.0100%, Mg: 0.0005% to 0.0100%, and REM: 0.0005% to 0.0100%.

* * * * *